US010222172B2

(12) United States Patent
Melville

(10) Patent No.: US 10,222,172 B2
(45) Date of Patent: Mar. 5, 2019

(54) EQUIPMENT RETENTION SYSTEM

(71) Applicant: Toby J. Melville, San Antonio, TX (US)

(72) Inventor: Toby J. Melville, San Antonio, TX (US)

( * ) Notice: Subject to any disclaimer, the term of this patent is extended or adjusted under 35 U.S.C. 154(b) by 505 days.

(21) Appl. No.: 14/143,952

(22) Filed: Dec. 30, 2013

(65) Prior Publication Data

US 2014/0109345 A1 Apr. 24, 2014

Related U.S. Application Data

(63) Continuation-in-part of application No. 29/442,770, filed on May 13, 2013, now Pat. No. Des. 695,870, and a continuation-in-part of application No. 29/395,396, filed on Jan. 12, 2012, now Pat. No. Des. 685,051.

(60) Provisional application No. 61/848,641, filed on Jan. 8, 2013.

(51) Int. Cl.

| | |
|---|---|
| ***F41C 33/00*** | (2006.01) |
| ***F41G 11/00*** | (2006.01) |
| ***F41C 33/04*** | (2006.01) |

(52) U.S. Cl.

CPC ..... *F41C 33/006* (2013.01); *F41C 33/041* (2013.01); *F41G 11/003* (2013.01); *A45F 2200/0591* (2013.01); *Y10T 24/13* (2015.01)

(58) Field of Classification Search

CPC .... F41C 33/006; F41C 33/041; F41C 33/007; F41C 33/008; F41G 11/003; F41G 1/35; Y10T 24/13; Y10T 24/1391; Y10T 403/599; Y10T 403/7073; A45F 2200/0591; F16B 21/09

USPC ..... 224/271; 24/3.1

See application file for complete search history.

(56) References Cited

U.S. PATENT DOCUMENTS

| | | | | |
|---|---|---|---|---|
| 5,730,342 | A * | 3/1998 | Tien | A45F 5/02 224/197 |
| 5,850,996 | A * | 12/1998 | Liang | A45F 5/02 224/197 |
| 6,371,424 | B1 * | 4/2002 | Shaw | F16M 11/02 248/187.1 |
| 7,458,489 | B1 * | 12/2008 | Mudd | A45F 5/02 224/197 |
| 8,166,694 | B2 | 5/2012 | Swan | |
| 2008/0216380 | A1 * | 9/2008 | Teetzel | F41G 11/003 42/127 |

(Continued)

*Primary Examiner* — Nathan J Newhouse
*Assistant Examiner* — Matthew T Theis
(74) *Attorney, Agent, or Firm* — Christopher L. Makay

(57) ABSTRACT

A retention system for equipment includes a base plate assembly and an adapter assembly securable to the equipment. The adapter assembly interface includes a locking recess The base plate assembly includes a base plate and an adapter assembly guide adjacent the base plate for receiving the interface therein thereby coupling the adapter assembly with the base plate assembly. The base plate assembly further includes a locking mechanism movable between an engaged position and a disengaged position. The locking mechanism in the engaged position engages the locking recess of the interface, thereby locking the adapter assembly with the base plate assembly. The locking mechanism in the disengaged position disengages from the locking recess of the interface, thereby unlocking the adapter assembly from the base plate assembly.

44 Claims, 19 Drawing Sheets

(56) References Cited

U.S. PATENT DOCUMENTS

| | | | | |
|---|---|---|---|---|
| 2009/0013580 | A1* | 1/2009 | Houde-Walter | F41G 11/003 42/114 |
| 2009/0293334 | A1* | 12/2009 | Swan | F41C 33/007 42/90 |
| 2010/0176174 | A1* | 7/2010 | Felts | F42B 39/02 224/666 |

* cited by examiner

EQUIPMENT RETENTION SYSTEM

CROSS-REFERENCE TO RELATED APPLICATIONS

This present application claims all available benefit, under 35 U.S.C. § 119(e), of U.S. provisional patent application Ser. No. 61/848,641 filed Jan. 8, 2013, and all benefit as a continuation-in-part application, under 35 U.S.C. § 120, of U.S. D685,051 filed Jan. 12, 2012, and U.S. D695,870 filed May 13, 2013. By this reference, the full disclosures of U.S. provisional patent application Ser. No. 61/848,641 and patent numbers U.S. D685,051 and U.S. D695,870 are incorporated herein as though now set forth in their entireties.

BACKGROUND OF THE INVENTION

1. Field of the Invention

The present invention relates generally to a retention system and more particularly, to a retention system for securing equipment such as pistols, rifles, shotguns, submachine guns, mechanical breaching tools, radios and the like.

2. Description of the Related Art

Tactical operators, soldiers, and law enforcement personnel require retention systems for their equipment including weapons such as rifles, pistols and shotguns. These retention systems must securely hold their equipment preventing loss and, in the case of weapons, accidental discharge while the tactical operators, soldiers, and law enforcement personnel are performing ordinary movements, and also when engaged in various physical activities such as running, jumping, or restraining persons, in addition, the retention systems must be difficult for an unauthorized user to remove the equipment, while still allowing the equipment to be easily accessed, rapidly withdrawn, and deployed.

In the field of weapon retention, there currently exist various types of holsters and retention systems to secure weapons. These retention systems typically are molded to fit a particular weapon and secure the weapon using friction and a locking mechanism. The friction and locking mechanism secure the weapon and help to prevent the unauthorized removal of the weapon while also allowing rapid deployment of the weapon. While effective in securing specific weapons, these retention systems typically are not interchangeable among different weapons because they conform in shape and size to a specific weapon and therefore cannot be used with different weapons.

While weapon specific retention systems operate adequately, a retention system interchangeable among different weapons as well as usable with different pieces of equipment provides desirable versatility to tactical operators, soldiers, and law enforcement personnel. Illustratively, modern firearms may be accessorized with various devices such as lights, lasers, and optics. However, an accessorized weapon may no longer fit in its specific retention system resulting in the necessity of procuring a new retention system conforming to the shape of the accessorized weapon. In addition, most retention systems currently available are not ambidextrous. Accordingly, a retention system that is interchangeable among weapons and equipment, ambidextrous, and usable with accessories would improve over current weapon and equipment specific retention systems.

SUMMARY OF THE INVENTION

A retention system for equipment includes an adapter assembly and a base plate assembly. The adapter assembly connects with equipment, whereas the base plate assembly attaches to an object or person. The adapter assembly removably couples with the base plate assembly to secure the equipment to an object or person having the base plate assembly thereon.

The adapter assembly includes an interface having a first end and a second end that tapers from the first end to the second end such that the first end is wider than the second end. The interface may include a locking recess. The adapter assembly includes a clamp comprised of a first clamp member adjustably securable to a second clamp member such that the first clamp member and the second clamp member are adapted to engage a device rail of equipment. The adapter assembly further includes an interface bracket coupled with the interface. The interface bracket is engageable with one of the first clamp member and the second clamp member, thereby making the adapter assembly ambidextrous. The first clamp member includes a main body having at least one lug slot on an upper surface thereof and a rail facilitating the attachment of devices thereto and a jaw engageable with a device rail of equipment. The second clamp member includes a main body adjustably securable with the main body of the first clamp member and a jaw engageable with a device rail of equipment.

The base plate assembly includes a base plate and an adapter assembly guide adjacent the base plate for receiving therein the interface of the adapter assembly. The base plate includes threaded rivets therein that facilitate securing of the base plate assembly with devices adapted for attachment to an object or a wearer of the retention system. The base plate may include a plunger channel, a locking assembly channel communicating with the plunger channel, and an aperture communicating with the locking assembly channel. The adapter assembly guide includes a first guide rail having a first portion and a second portion opposed to a second guide rail having a first portion and a second portion. The first and second guide rails are spaced apart at their first portions wider than the interface of the adapter assembly to facilitate insertion of the interface between the first and second guide rails. The first and second guide rails taper along their second portions and are spaced apart at their second portions substantially the same as the width of the interface of the adapter assembly such that the first and second guide rails engage the interface thereby coupling the adapter assembly with the base plate assembly. The first and second guide rails each define a groove that engages the interface of the adapter assembly to maintain the adapter assembly seated between the first and second guide rails. The adapter assembly guide includes a stop that arrests the insertion of the interface of the adapter assembly therein.

The base plate assembly may further include a locking mechanism movable between an engaged position and a disengaged position. The locking mechanism in the engaged position engages the locking recess of the interface, thereby locking the adapter assembly with the base plate assembly. The locking mechanism in the disengaged position disengages from the locking recess of the interface, thereby unlocking the adapter assembly from the base plate assembly.

The locking mechanism includes a locking assembly disposed in the locking assembly channel and biased to extend through the aperture such that the locking assembly engages the locking recess of the interface. The insertion of the interface of the adapter assembly into the adapter assembly guide depresses the locking assembly until the locking recess of the interface aligns with the aperture of the base plate. The locking assembly includes a hinge pin, a latch pivotable about the hinge pin, and a biasing member that biases the latch to extend through the aperture such that the latch engages the locking recess of the interface.

The locking mechanism further includes a plunger communicating with the locking assembly. The plunger is disposed in the plunger channel and extends therefrom. Movement of the plunger moves the locking assembly from the aperture such that the locking assembly disengages from the locking recess of the interface. The plunger includes a ward engagement key and the plunger channel includes a ward that limits the movement of the plunger relative to the locking assembly. A back plate securable with the base plate maintains the plunger within the plunger channel and the locking assembly within the locking assembly channel.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

Figure 10:
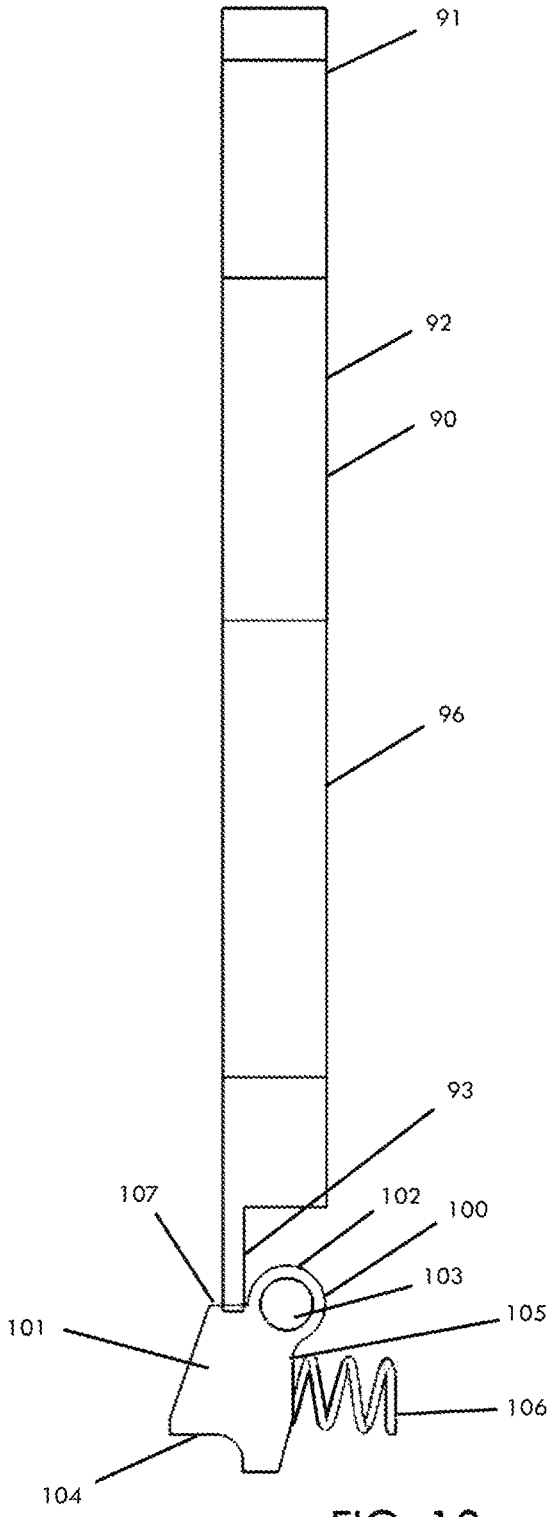
FIG. 10 is a side view illustrating a plunger and a locking assembly for the retention system according to the first embodiment.
Figure 11:
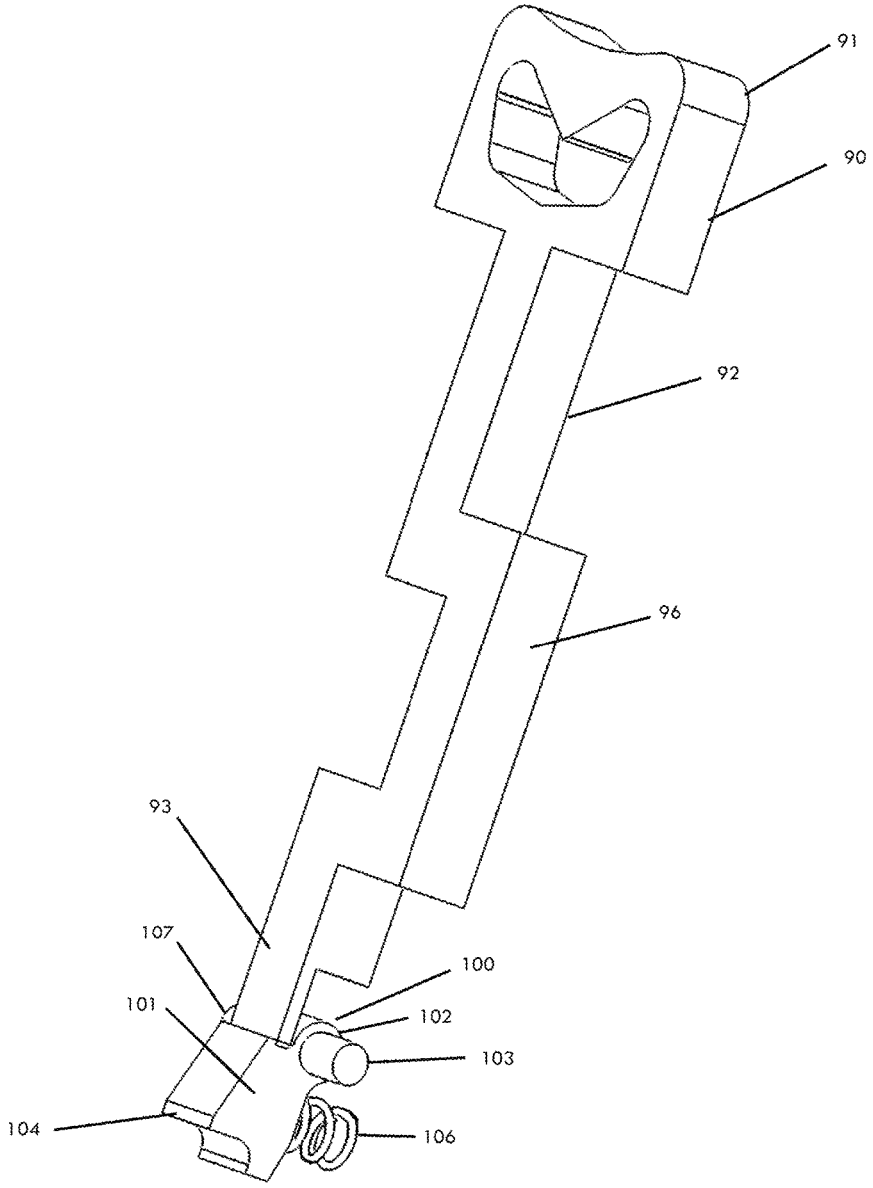
FIG. 11 is a perspective view illustrating the plunger and the locking assembly for the retention system according to the first embodiment.
Figure 12:
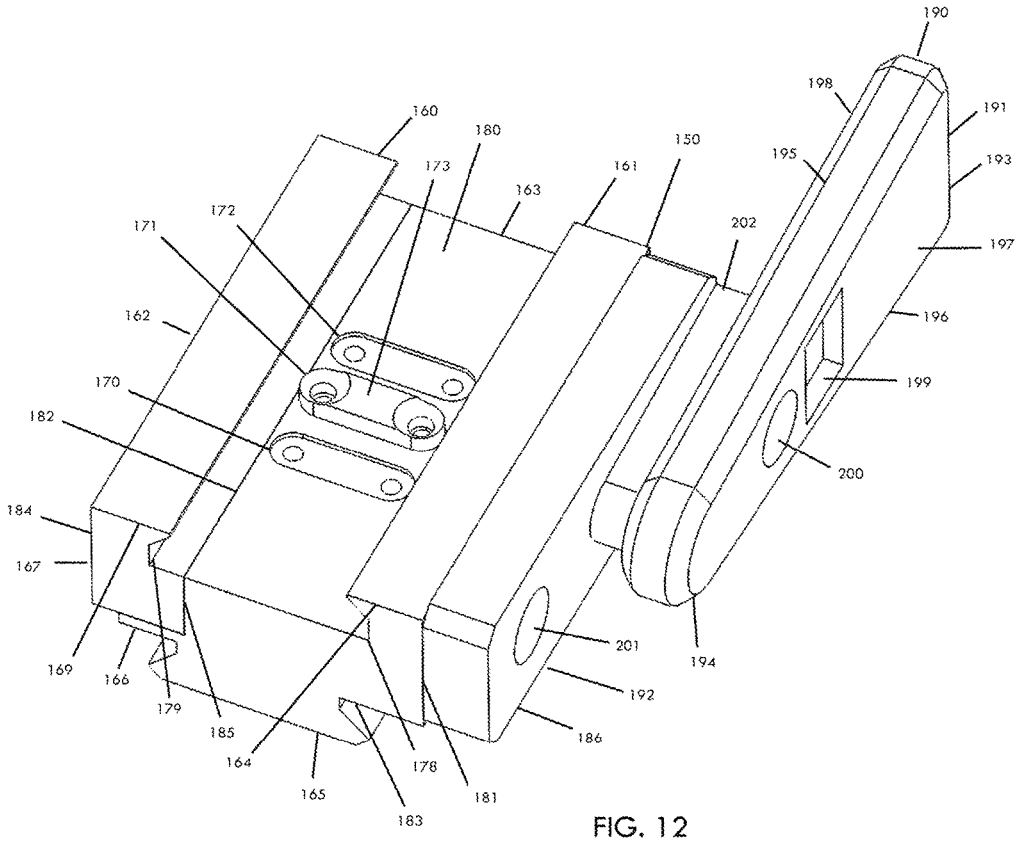
FIG. 12 is a perspective view illustrating a rail adapter assembly for the retention system according to the first embodiment.
Figure 13:
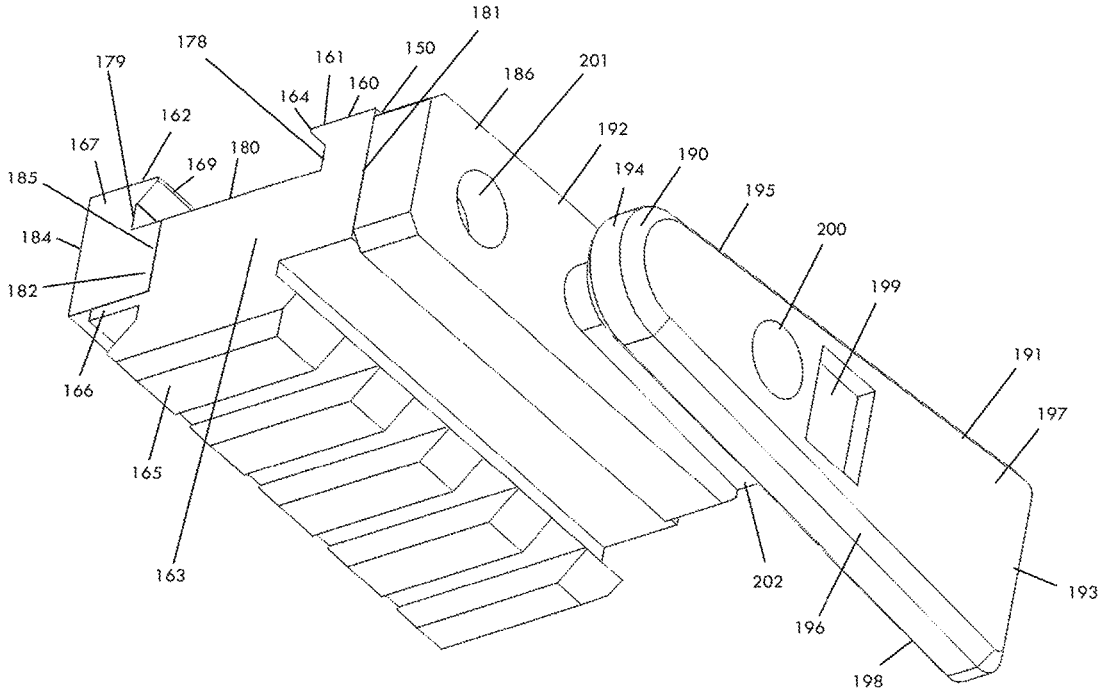
FIG. 13 is a perspective view illustrating the rail adapter assembly for the retention system according to the first embodiment.
Figure 14:
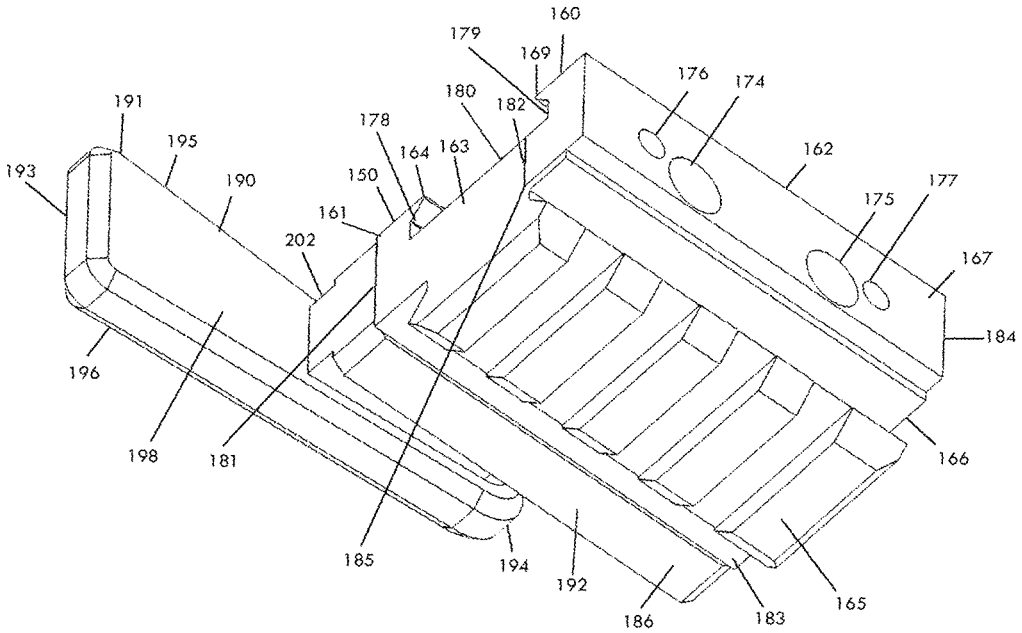
FIG. 14 is a perspective view illustrating the rail adapter assembly bly for the retention system according to the first embodiment.

FIGS. 1-14 illustrate a first embodiment of a retention system 10 for a piece of equipment such as a weapon including but not limited to pistols, rifles, shotguns, submachine guns, and the like, wherein FIGS. 1-11 illustrate a base plate assembly 20 of the retention system 10 and FIGS. 12-14 illustrate a rail adapter assembly 150 of the retention system 10. The base plate assembly 20 and the rail adapter assembly 150 are designed to integrate with each other and provide modularity, security, and the ability to service both right handed and left handed users. The rail adapter assembly 150 provides modularity and adaptability in that it attaches to any suitable piece of equipment such as a weapon platform and is configurable for both right handed and left handed users. The base plate assembly 20 receives the rail adapter assembly 150 therein and attaches to a user's body at a variety of locations to secure the rail adapter assembly 150 and thus the user's device to the user. The base plate assembly 20 further includes a locking mechanism for securing the rail adapter assembly 150 with the base plate assembly 20.

The base plate assembly 20 includes a base plate 30, substantially rectangular in the present embodiment, and having a front 31, a back 32, a top 33, a bottom 34, a right side 35, and a left side 36; a rail adapter assembly guide 40; a plunger 90; a locking assembly 100; and a back plate 88.

As illustrated in FIGS. 1-5, the rail adapter assembly guide 40 resides at the front 31 of the base plate 30 and includes guide rails 41 and 42 defining a guide channel 43 and a guide surface 44. The rail adapter assembly guide 40 further includes a stop 45 at a lower end thereof between the guide rails 41 and 42. The guide surface 44 includes an aperture 39 therethrough that allows the locking assembly 100 to engage the rail adapter assembly 150. The guide rails 41 and 42 include grooves 46 and 47, respectively, provided to engage the rail adapter assembly 150. In the present embodiment, the guide rails 41 and 42 are shaped to form a funnel that is wide near the top 33 of the base plate 30 and tapers as it approaches the bottom 34 of the base plate 30. The funnel shape of the guide rails 41 and 42 as well as the grooves 46 and 47 direct the rail adapter assembly 150 towards the aperture 39 in order to allow a user of the retention system 10 to rapidly secure a weapon or the like to the base plate assembly 20 through tactile feel as will be explained in greater detail herein.

Figure 8:
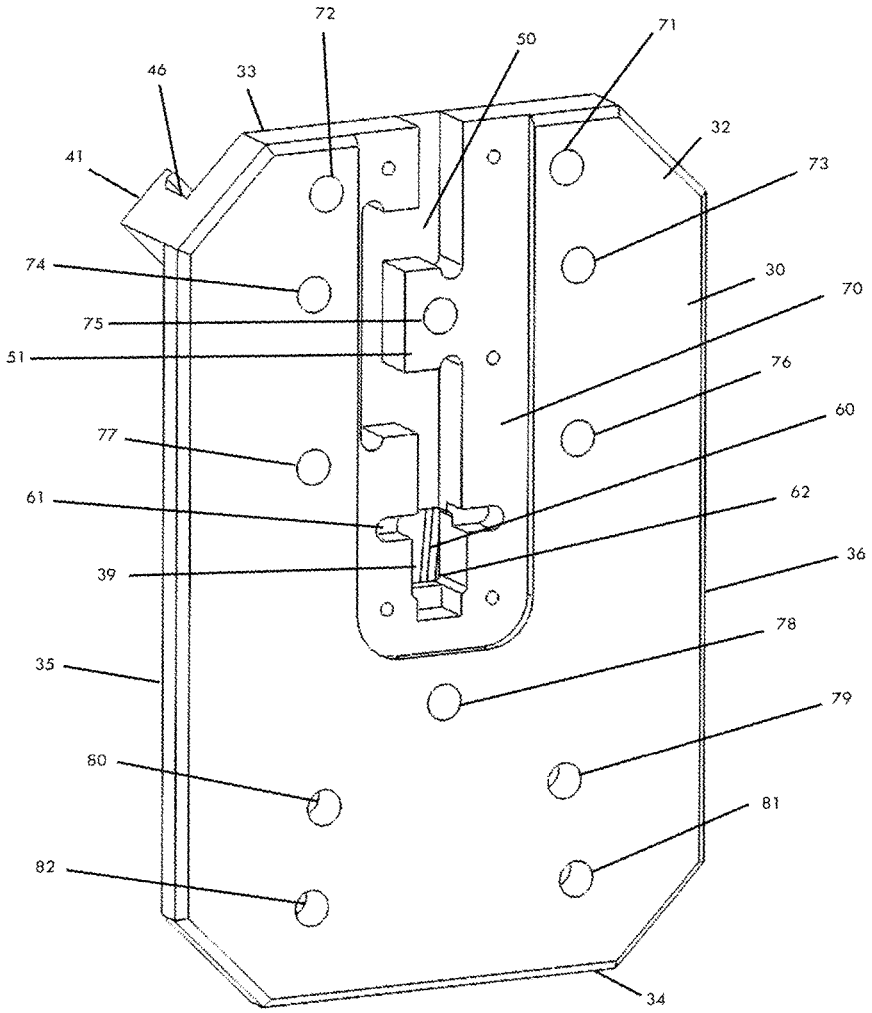
FIG. 8 is a back view in perspective illustrating the base plate for the retention system according to the first embodiment.
Figure 9:
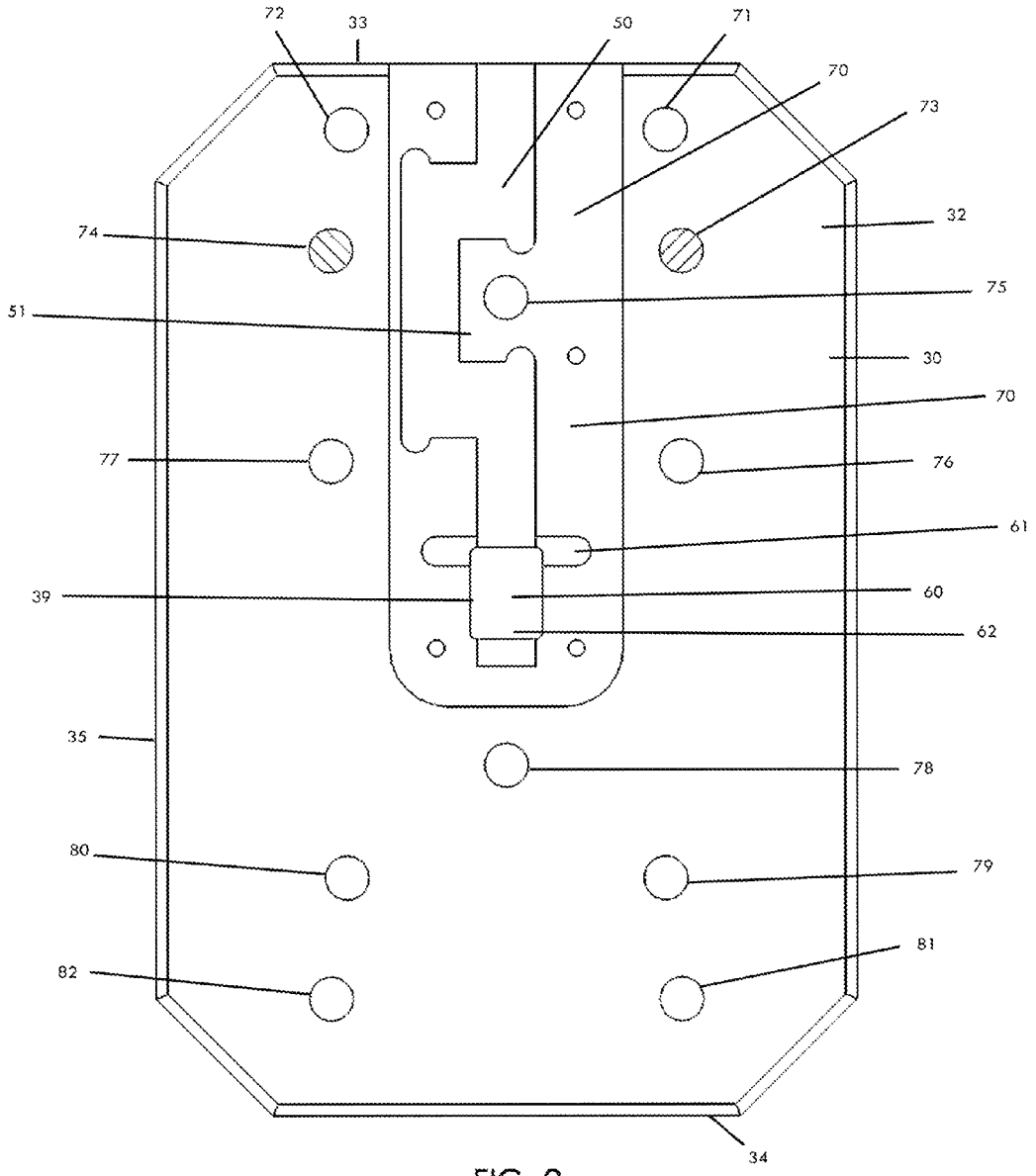
FIG. 9 is a back view illustrating the base plate for the retention system according to the first embodiment.

As illustrated in FIGS. 8 and 9, the base plate 30 at the back 32 thereof includes a plunger channel 50, a locking assembly channel 60, a back plate groove 70, and bores 71-82. The plunger channel 50 receives the plunger 90 therein and is designed to allow the plunger 90 to move within the plunger channel 50 along a central axis of the plunger channel 50. Although the shape of the plunger channel 50 allows the plunger 90 to move, the plunger channel includes a ward 51 that limits the movement of the plunger 90 to prevent damage to the plunger 90 as well as to the locking assembly 100.

The locking assembly channel 60 includes a hinge cavity 61 and a latch cavity 62 communicating with the aperture 39. The locking assembly channel 60 receives the locking assembly 100 therein such that the locking assembly 100 extends through the aperture 39 and engages the rail adapter assembly 150.

The bores 71-82 in the preferred embodiment have rivets press fit therein. The rivets are threaded to allow coupling of the base plate assembly 20 with various attachment devices. Illustratively, molly straps securable to a variety of surfaces such as tactical vests or belts may be attached to the base plate 30.

In the present embodiment, the base plate 30 and the rail adapter assembly guide 40 are formed integrally from any suitable material, such as plastic or metal, and formed using any suitable method such as milling or injection molding. In particular, the base plate 30 and the rail adapter assembly guide 40 in the preferred embodiment are milled as one piece from Delrin®. Nevertheless, those of ordinary skill in the art will recognize that the base plate 30 and the rail adapter assembly guide 40 could be formed separately and combined.

Figure 1:
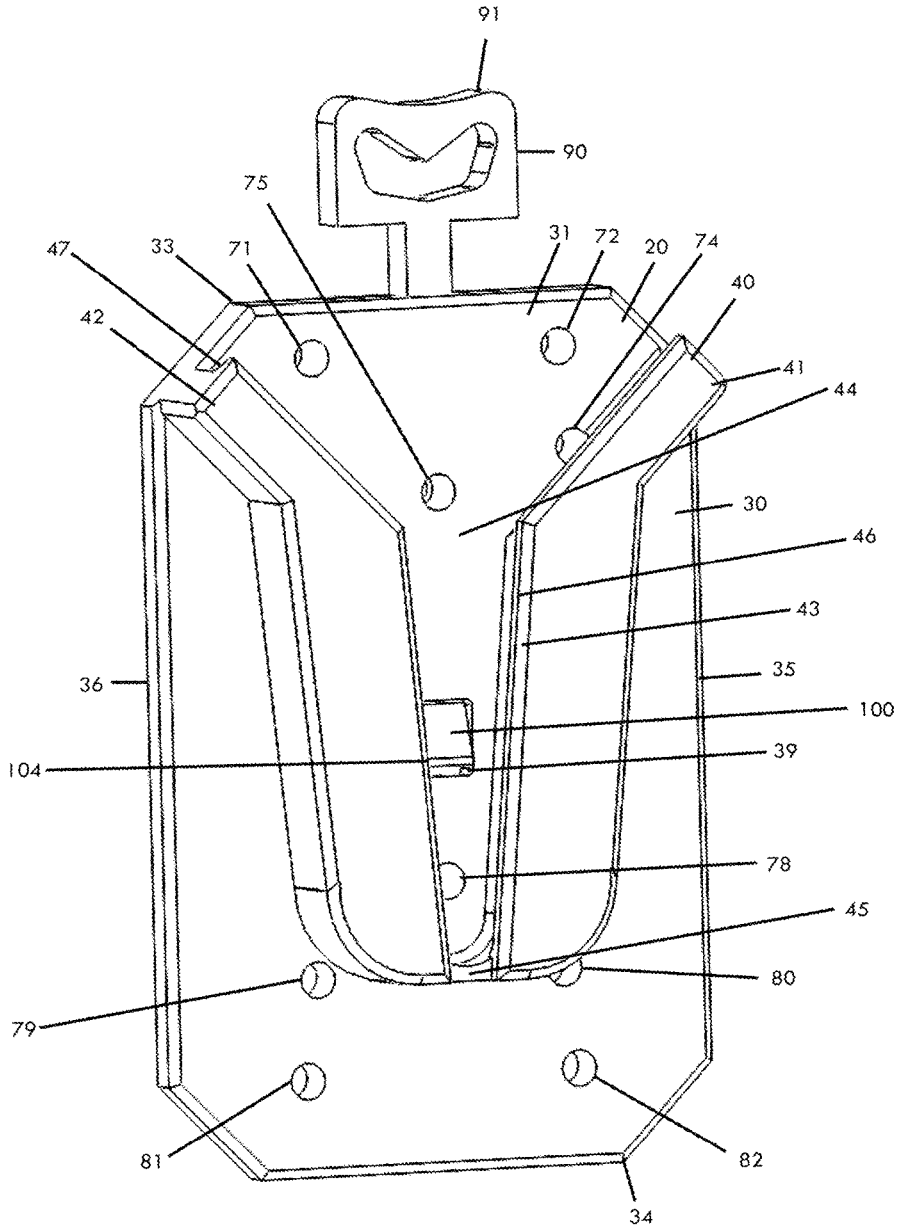
FIG. 1 is a front view in perspective illustrating a base plate assembly for a retention system according to a first embodiment.
Figure 2:
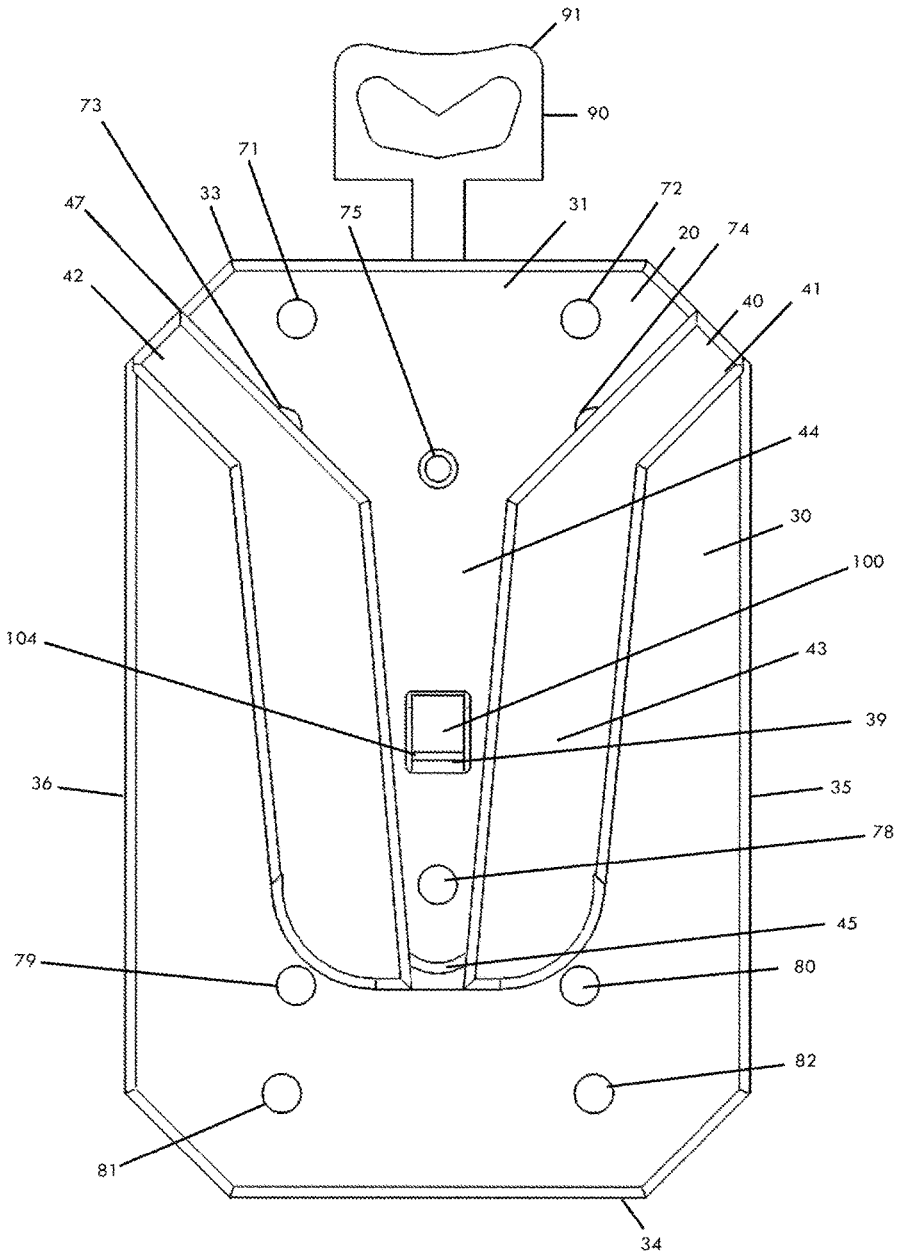
FIG. 2 is a front view illustrating the base plate assembly for the retention system according to the first embodiment.
Figure 3:
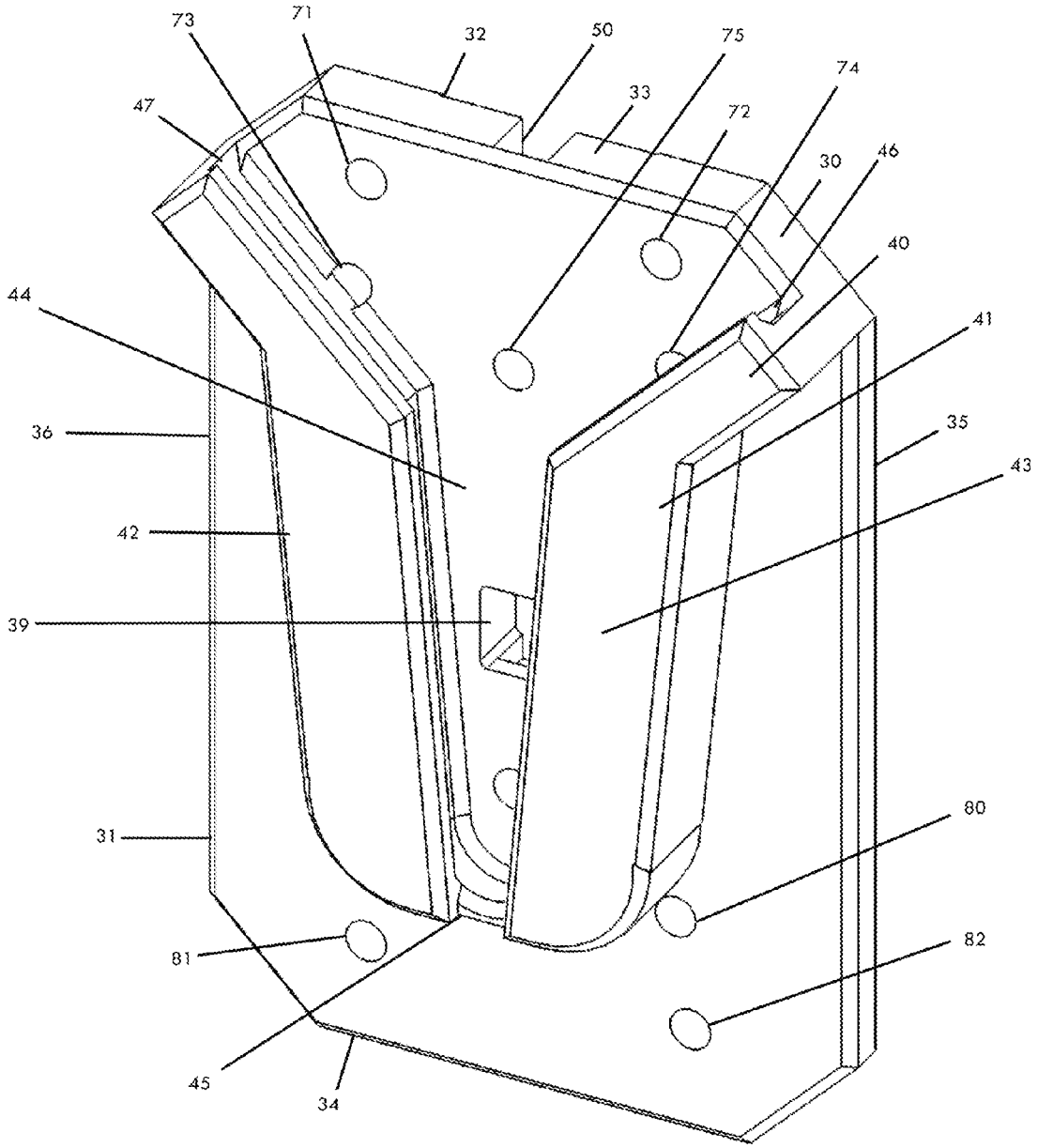
FIG. 3 is a front view in perspective illustrating a base plate for the retention system according to the first embodiment.
Figure 4:
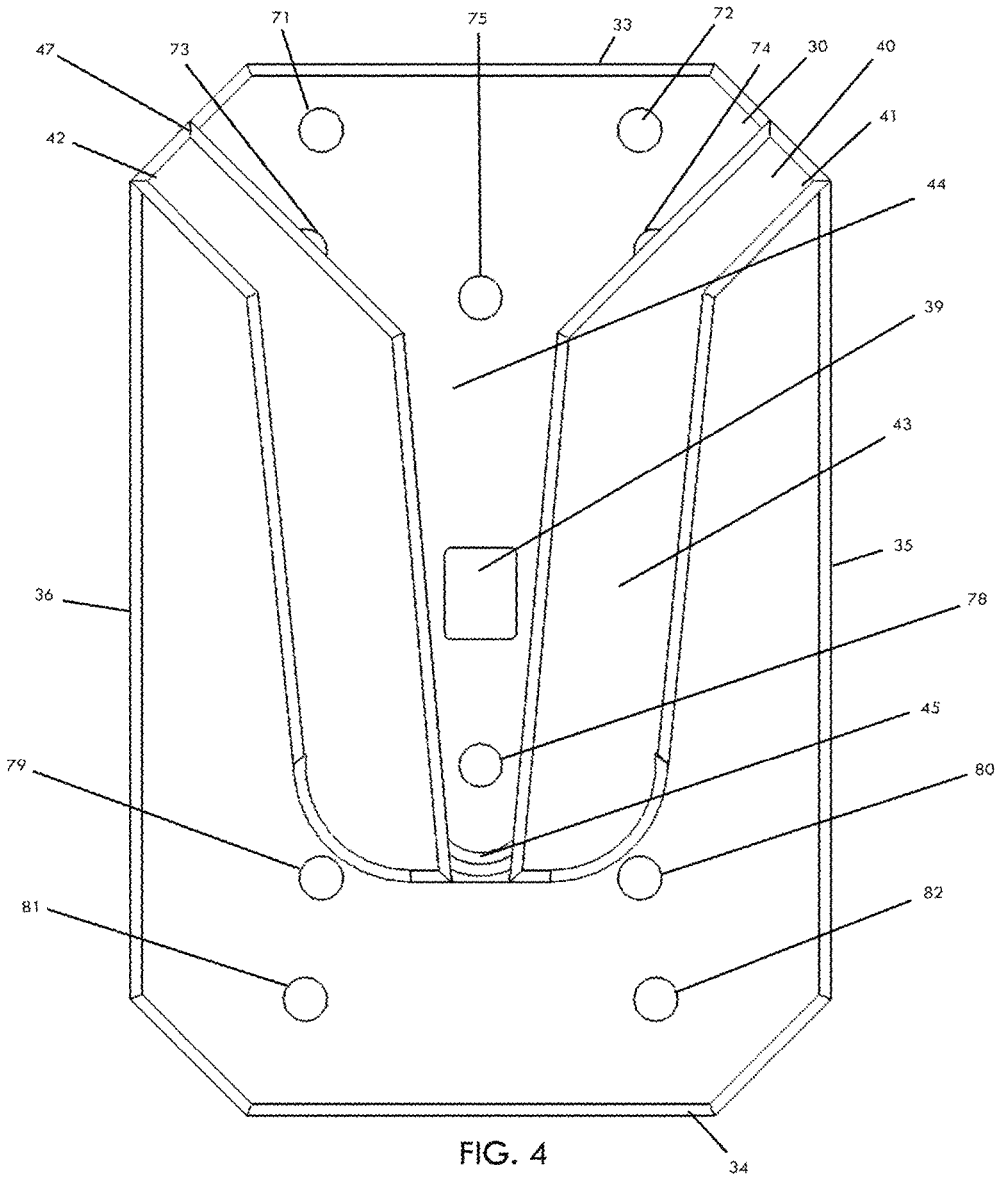
FIG. 4 is a front view illustrating the base plate for the retention system according to the first embodiment.
Figure 5:
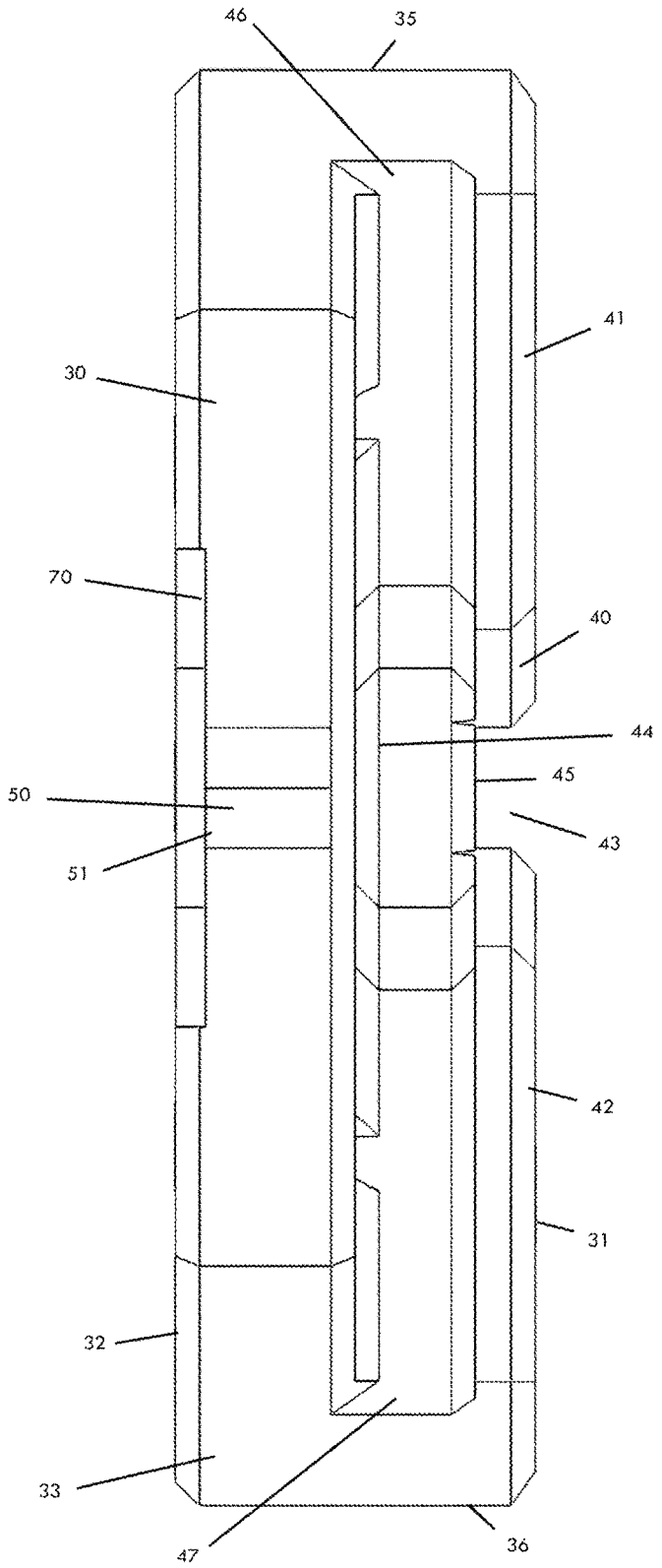
FIG. 5 is a top view illustrating the base plate for the retention system according to the first embodiment.
Figure 6:
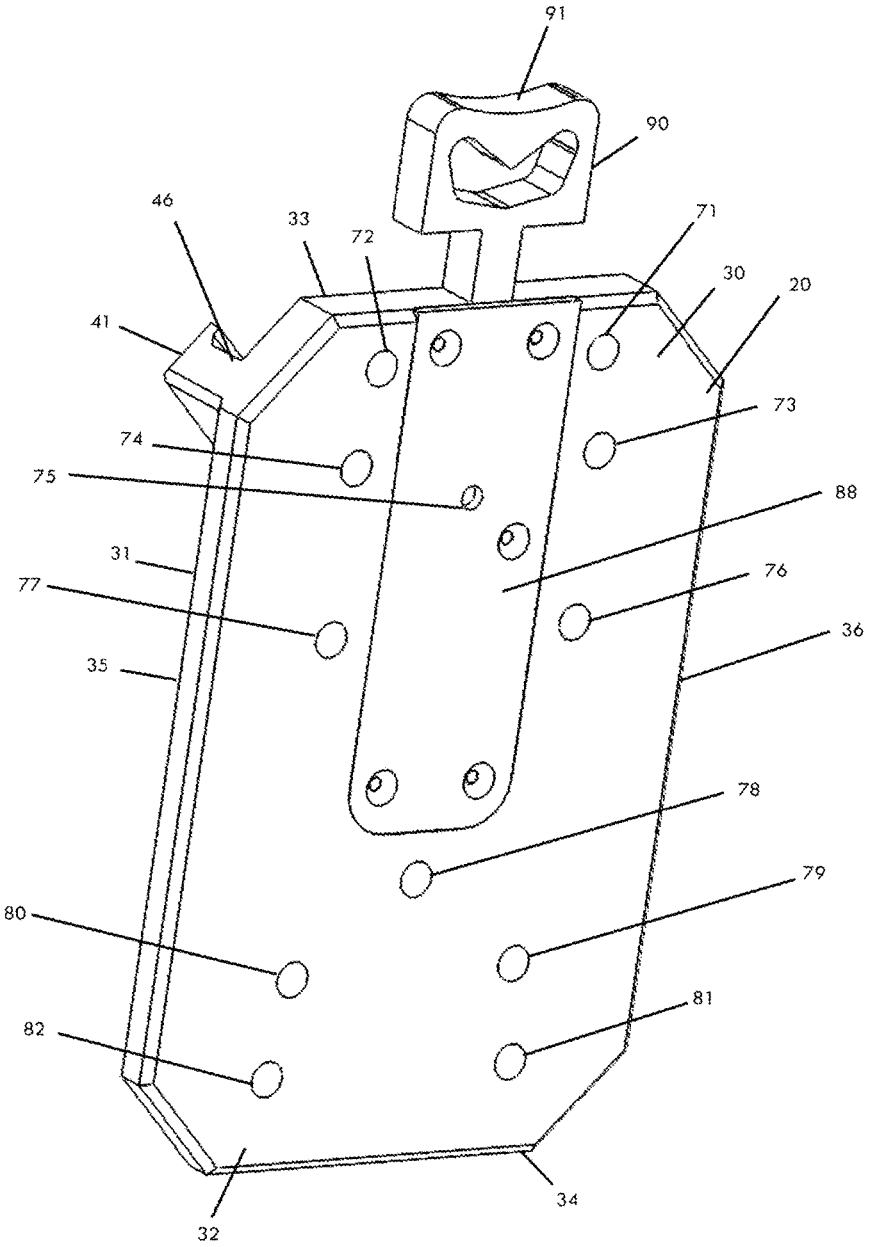
FIG. 6 is a back view in perspective illustrating the base plate assembly for the retention system according to the first embodiment.
Figure 7:
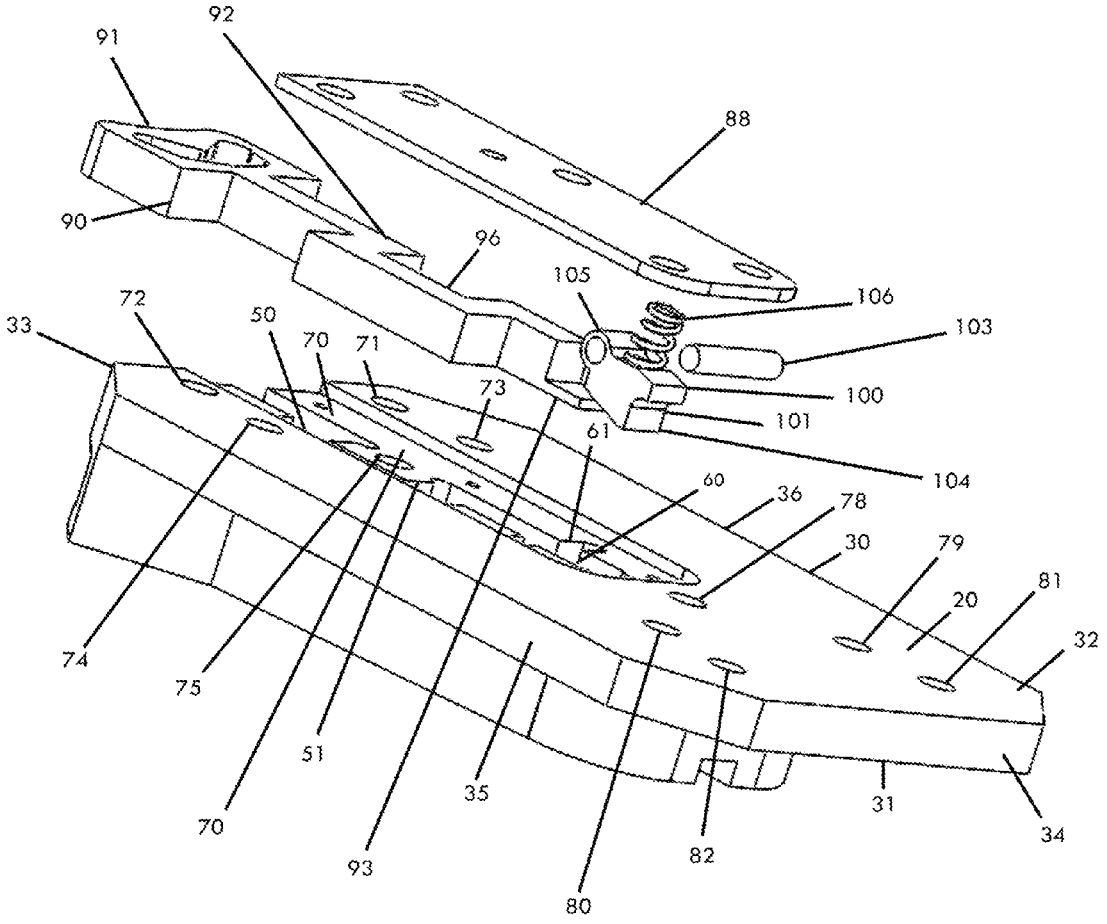
FIG. 7 is an exploded back view in perspective illustrating the base plate assembly for the retention system according to the first embodiment.

FIG. 7 illustrates how the back plate 88 maintains the plunger 90 within the plunger channel 50 and the locking assembly 100 within the locking assembly channel 60. The back plate 88 is placed within the back plate groove 70 over the plunger channel 50 and the locking assembly channel 60 such that the plunger 90 remains seated within the plunger channel 50 and the locking assembly 100 remains seated within the locking assembly channel 60. The back plate 88 secures to the base plate 20 using any suitable means such as screws placed within threaded apertures 83-87 located at the back plate groove 70. The back plate 88 may be constructed from any suitable material such as Delrin®, however, the back plate 88 in the present embodiment is aluminum.

FIGS. 10 and 11 illustrate the plunger 90 and the locking assembly 100. The locking assembly 100 of the base plate assembly 20 includes a latch 101, a hinge pin 103, and a biasing member 106, which in the present embodiment is a spring. The latch 101 includes a hinge 102, a locking notch 104, a biasing member interface 105, and a tab interface 107. The latch 101 and the hinge pin 103 can be made of any suitable material but in the present embodiment is made from aluminum. The latch 101 resides within the latch cavity 62 of the locking assembly channel 60 such that the tab interface 107 faces the plunger channel 50 and the locking notch 104 aligns with and extends through the aperture 39. In addition, a first end of the biasing member 106 resides within the locking assembly channel 60 and against the back plate 88, while a second end of the biasing member 106 engages the biasing member interface 105 of the latch 101. The biasing member 106 accordingly maintains the locking notch 104 extended through the aperture 39 in an engagement position, whereby the locking notch 104 engages the rail adapter assembly 150 to prevent unauthorized removal of a device such as a weapon or the like. The hinge pin 103 is placed through the hinge 102 and both the hinge pin 103 and the hinge 102 reside within the hinge cavity 61 of the locking assembly channel 60 and against the back plate 88 in order to allow the rotation of the latch 101 between engaged and disengaged positions.

The plunger 90 includes an actuator 91, a shaft 92, and a release tab 93. The plunger 90 may be constructed from any suitable material, however, the plunger 90 in the present embodiment is aluminum. The shaft 92 seats within the plunger channel 50 and includes a ward engagement key 96 that engages the ward 51 of the plunger channel 50. The design of the ward 51 and the ward engagement key 96 allows movement of the plunger 90 along the central axis of the plunger channel 50 but prevents the plunger 90 from stressing the locking assembly 100 or being inadvertently removed from the base plate 30. The release tab 93 of the plunger 90 directly engages the tab interface 107 of the locking assembly 100. The actuator 91 extends beyond the plunger channel 50 and allows a user to press the plunger 90 such that the plunger 90 via the release tab 93 moves the locking assembly 100 from an engaged to a disengaged position. Release of the actuator allows the biasing member 106 to return the locking assembly 100 to its engaged position.

FIG. 7 illustrates how the base plate assembly 20 of the retention system 10 assembles. Threaded rivets are press fit into the bores 71-82 of the base plate 30 to allow coupling of the base plate assembly 20 with attachment devices. The hinge pin 103 slides through and fits within the hinge 102 of the latch 101, and the release tab 93 of the plunger 90 engages the tab interface 107 of the latch 101 such that the plunger 90 interfaces with the locking assembly 100. The plunger 90 and the latch 101 including the hinge pin 103 are placed respectively within the plunger channel 50 and the locking assembly channel 60. The plunger 90 is oriented within the plunger channel 50 such that the actuator 91 resides adjacent the top 33 of the base plate 30 and extends beyond the plunger channel 50. Furthermore, the ward engagement key 96 of the shaft 92 fits within the plunger channel 50 around the ward 51. The latch 101 is oriented within the locking assembly channel 60 such that the hinge 102 and the hinge pin 103 reside within the hinge cavity 61, and the locking notch 104 of the latch 101 resides within the latch cavity 62 aligned with and extending through the aperture 39. At this point, the plunger 90 and the latch 101 reside respectively within the plunger channel 50 and the locking assembly channel 60 and interface at the release tab 93 and the tab interface 107.

The biasing member 106 is then placed within the locking assembly channel 60 with its second end engaged with the biasing member interface 105 of the latch 101 and its first end facing the back plate groove 70. The back plate 88 inserts within the back plate groove 70 such that the back plate 88 resides over the plunger 90, the latch 101, the hinge 102, and the first end of the biasing member 106. The back plate 88 secures to the base plate 30 using any suitable means such as screws placed within the threaded apertures 83-87.

Once the back plate 88 connects to the base plate 30, the locking assembly 100 is complete, and the biasing member 106 maintains the locking notch 104 extended through the aperture 39 in the engagement position, whereby the locking notch 104 engages the rail adapter assembly 150 to prevent unauthorized removal of a device such as a weapon and the like. In addition, the actuator 91 extends beyond the plunger channel 50 and allows a user to press the plunger 90 such that the plunger 90 via the release tab 93 moves the locking assembly 100 from its engaged position to its disengaged position. Release of the actuator 91 allows the biasing member 106 to return the locking assembly 100 from its disengaged position to its engaged position.

FIGS. 12-14 illustrate the rail adapter assembly 150 of the retention system 10. The rail adapter assembly 150 mounts to any suitable rail system for a piece of equipment. Illustratively, the rail adapter assembly 150 mounts to an accessory rail of a weapon such as rifle or pistol such that interfacing of the rail adapter assembly 150 with the base plate assembly 20 secures the weapon to a user. The rail adapter assembly 150 may be constructed from any suitable material such as aluminum, titanium, or carbon fiber.

The rail adapter assembly 150 includes a clamp 160 and an interface assembly 190. The interface assembly 190 includes an interface 191 and an interface bracket 192. The clamp includes a first clamp member 161 and a second clamp member 162. The first clamp member 161 includes a main body 163 having lug slots 170-172 on an upper surface 180 thereof and attachment points on first and second sides 181 and 182 thereof. The main body 163 further includes a jaw 164 integral therewith at the first side 181, a rail 165 integral therewith with at a bottom 183 thereof, and a clamp member support 166 integral therewith at the second side 182. The second clamp member 162 includes a main body 167 having at a first side 184 recessed apertures 174 and 175 therethrough and attachment points 176 and 177. The main body 167 further includes a jaw 169 integral therewith at the first side 184 and a second side 185. While the first and second clamp members 161 and 162 may be constructed from any suitable material including carbon fiber, the clamp members in the present embodiment are aluminum. In addition, the attachment points in the present embodiment are holes drilled and tapped, although, one of ordinary skill in the art will recognize alternative attachment points and methods.

The attachment points on the first side 181 of the first clamp member 161 and the attachment points 176 and 177 of the second clamp member 162 are designed to receive screws that allow the attachment of the interface assembly 190 to the main body 163 of the first clamp member 161 or the main body 167 of the second clamp member 162. The clamp member support 166 of the first clamp member 161 is a bracket that receives and supports the second clamp member 162 when the second clamp member 162 attaches to the main body 163 of the first clamp member 161. The second clamp member 162 resides atop the clamp member support 166 and attaches to the main body 163 of the first clamp member 161 using any suitable means. However, in the present embodiment, the second clamp member 162 attaches to the main body 163 of the first clamp member 161 using screws placed within and extending through the recessed apertures 174 and 175 such that the screws engage the attachment points located on the second side 182 of the main body 163 for the first clamp member 161.

As stated above, the clamp 160 is designed to integrate with a common device rail such as a picatinny or weaver type rail. Accordingly, the jaw 164 of the first clamp member 161 includes a groove 178 and the jaw 165 the second clamp member 162 includes a groove 179 designed to receive therein the device rail of a piece of equipment. Furthermore, the second clamp member 162 is adjustable relative to the main body 163 of the first clamp member 161 between a disengaged position and an engaged position, whereby the clamp 160 secures to the device rail. In addition, the lug slots 170-172 are designed to receive and secure a lug 173 to the first clamp member 161. The lug 173 fits within the slots of a device rail and allows fore and aft adjustment on the device rail as well as prevents fore and aft movement of the rail adapter assembly 150 when the rail adapter assembly 150 is attached a piece of equipment.

The rail adapter assembly 150 attaches to a piece of equipment in order to interface the piece of equipment with the base plate assembly 20 and allow the piece of equipment to be secured to a user. The rail adapter assembly 150 attaches to a device rail of the piece of equipment and, as such, precludes the use of other devices such as flashlights, laser, and the like. Accordingly, the first clamp member 161 includes the rail 165 for the purpose of providing a device attachment point. The rail 165 of the first clamp member 161 therefore allows devices such as lasers, lights, and the like to be attached to the rail adapter assembly 150. The rail 165 of the first clamp member 161 may be any suitable rail system adapted for the securing of devices to the rail adapter assembly 150. In the present embodiment, the rail 165 comprises a picatinny rail, however, one of ordinary skill in the art will recognize any other suitable rail such as a weaver type rail.

The interface 191 and the interface bracket 192 of the interface assembly 190 in the present embodiment are formed integrally from any suitable material, such as plastic or metal, and manufactured using any suitable method such as milling or injection molding. In particular, the interface 191 and the interface bracket 192 are milled as one piece from aluminum. Nevertheless, those of ordinary skill in the art will recognize that the interface 191 and the interface bracket 192 could be formed separately and combined.

The interface 191 includes a first end 193, a second end 194, and first and second sides 195 and 196. In the present embodiment, the second end 194 incorporates a curved surface to facilitate insertion of the interface 191 into the guide channel 43. The interface 191 further includes a guide face 197 and a platform face 198. The guide face 197 includes a locking recess 199 and a recessed aperture 200. The locking recess 199 is designed to receive the locking notch 104 of the locking assembly 100 therein and allow the locking notch 104 to achieve its engagement en position.

The interface 191 in the present embodiment is triangular in shape and engages the guide channel 43 of the rail adapter assembly guide 40 using a tongue and groove method. The triangular shape of the interface 191 produces a taper from the first end 193 to the second end 194 and allows a user to guide the interface 191 and therefore the rail adapter assembly 150 into the rail adapter assembly guide 40 of the base plate assembly 20 for securing thereto. In particular, the first and second sides 195 and 196 slide within and engage the grooves 46 and 47 of the guide rails 41 and 42. The interface 191 inserts into the rail adapter assembly guide 40 until the second end 194 abuts the stop 45 of the rail adapter assembly guide 40. Furthermore, the guide face 197 abuts the guide surface 44 such that the guide face 197 moves the locking notch 104 of the locking assembly 100 into its disengaged position and maintains the locking notch 104 disengaged position until the interface 191 seats within the rail adapter assembly guide 40. Once the interface 191 seats completely within the rail adapter assembly guide 40, the locking recess 199 resides over the locking notch 104 of the locking assembly 100, which allows the biasing member 106 to bias the locking notch 104 into its engaged position within the locking recess 199. The locking notch 104 accordingly engages the locking recess 199, thereby locking the rail adapter assembly 150 to the base plate assembly 20.

In addition to engaging the guide channel 43, the interface 191 also provides a user with a support platform. Illustratively, when the rail adapter assembly 150 is attached to a weapon, such as a pistol, the first side 195, the second side 196, and the guide face 197 of the interface 191 provide surfaces for a user to rest their thumb when engaging targets with the pistol. For example, a right hand user places their thumb on the first side 195 and applies a downward force thereby enhancing recoil control and producing better accuracy when engaging multiple targets.

The interface bracket 192 includes a main body 186 having a recessed aperture 201. The interface bracket 192 further includes a platform 202 formed integrally between the main body 186 and the platform face 198 in order to integrate the interface bracket 192 with the interface 191. In the present embodiment, the interface assembly 190 is designed for use in either a right hand or a left hand configuration in that the interface assembly 190 attaches to either the first clamp member 161 or the second clamp member 162. Accordingly, the interface 191 includes the recessed aperture 200 and the interface bracket 192 includes the recessed aperture 201. In a right hand configuration, the interface assembly 190 is placed adjacent the first clamp member 161 and secured to the first clamp member 161 using any suitable means. In the present embodiment, however, the interface assembly 190 attaches to the main body 163 of the first clamp member 161 using screws placed within and extending through the recessed apertures 201 and 202 such that the screws engage the attachment points located on the first side 181 of the main body 163 for the first clamp member 161. In a left hand configuration, the interface assembly 190 is placed adjacent the second clamp member 162 and secured to the second clamp member 162 using any suitable means. In the present embodiment, however, the interface assembly 190 attaches to the main body 167 of the second clamp member 162 using screws placed within and extending through the recessed apertures 201 and 202 such that the screws engage attachment points 176 and 177 located on the first side 184 of the main body 167 for the second clamp member 162.

To aid in the understanding of the present invention, the retention system 10 will be described herein used in combination with a weapon, in particular a pistol. A user begins by coupling the base plate assembly 20 with an attachment device such as molly straps. The user couples the base plate assembly 20 to the molly straps by placing screws into the threaded rivets within the bores 71-82. The base plate assembly 20 via the coupled molly straps is then attached to a suitable surface on the user such as a belt or tactical vest.

A user next attaches the clamp 160 to a device rail of a pistol. The user selects a lug slot 170-172 of the first clamp member 161 and secures the lug 173 therein. As previously described, the second clamp member 162 resides atop the clamp member support 167 and attaches to the first clamp member 161 using screws placed within and extending through the recessed apertures 174 and 175 such that the screws engage the attachment points located on the second side 182 of the main body 163 for the first clamp member 161. While the second clamp member 162 and the first clamp member 161 couple together, it should be noted that, at this point, the second clamp member 162 begins in a disengaged position relative to the first clamp member 161. In the disengaged position, the screws remain untightened, and the second clamp member 162 moves relative to the first clamp member 161 in order to allow adjustability when securing the clamp 160 on the device rail. A user aligns the clamp 160 of the rail adapter assembly 150 with the device rail of the pistol such that the groove 178 of the first clamp member 161 aligns with a first side of the device rail and the groove 179 of the second clamp member 162 aligns with a second side of the device rail. In addition, the user selects a slot on the device rail and places the lug 173 within the slot. The user then moves the second clamp member 162 into its engaged position by tightening the screws, resulting in the jaw 164 of the first clamp member 161 engaging the first side of the device rail and the jaw 169 of the second clamp member 162 engaging the second side of the device rail. In the engaged position of the second clamp member 162, the clamp 160 remains secured to the device rail of the pistol, while the lug 173 prevents fore or aft movement of the clamp 160 along the device rail. While the foregoing example employs the lug 173 inserted into a slot of the device rail for the pistol, one of ordinary skill in the art will recognize that the lug 173 may be removed from the clamp 160 for device rails without slots.

The user next selects either a right hand or a left hand configuration for the rail adapter assembly 150. A right hand configuration entails securing the interface assembly 160 to the first clamp member 161 as illustrated in FIGS. 12-14. In the right hand configuration, the user places the interface assembly 190 adjacent the first clamp member 161 and attaches the interface assembly 190 to the first clamp member 161 using screws placed within and extending through the recessed apertures 201 and 202 such that the screws engage the attachment points located on the first side 181 of the main body 163 for the first clamp member 161. A left hand configuration entails securing the interface assembly 160 to the second clamp member 162. In the left hand configuration, the user places the interface assembly 190 adjacent the second clamp member 162 and attaches the interface assembly 190 to the second clamp member 162 using screws placed within and extending through the recessed apertures 201 and 202 such that the screws engage attachment points 176 and 177 located on the first side 184 of the main body 167 for the second clamp member 162.

Once the rail adapter assembly 150 is secured to the device rail of the pistol, the rail adapter assembly 150 as well as the pistol is ready for securing with the base plate assembly 20. The user grasps the pistol and positions the rail adapter assembly 150 such that the second end 194 of the interface 191 aligns with the guide channel 43 of the rail adapter assembly guide 40 and the guide face 197 of the interface 191 aligns with the guide surface 44. After alignment, the user exerts a pushing force on the attached pistol in a direction along the central axis of the base plate 30. This pushing force moves the first and second sides 195 and 196 of the interface 191 into engagement with the grooves 46 and 47 of the guide rails 41 and 42, thereby inserting the interface 191 into the rail adapter assembly guide 40. The interface 191 inserts into the rail adapter assembly guide 40 until the second end 194 abuts the stop 45 of the rail adapter assembly guide 40. Furthermore, the guide face 197 abuts the guide surface 44 such that the guide face 197 moves the locking notch 104 of the locking assembly 100 into its disengaged position and maintains the locking notch 104 disengaged until the interface 191 seats completely within the rail adapter assembly guide 40. Once the interface 191 seats completely within the rail adapter assembly guide 40, the locking recess 199 resides over the locking notch 104 of the locking assembly 100, which allows the biasing member 106 to bias the locking notch 104 into its engaged position within the locking recess 199. The locking notch 104 accordingly engages the locking recess 199, thereby locking the rail adapter assembly 150 and thus the pistol to the base plate assembly 20.

To remove the rail adapter assembly 150 as well as the pistol from the base plate assembly 20, the user presses the actuator 91 of the plunger 90 into the plunger channel 50. Pressing of the actuator 91 moves the locking assembly 100 from an engaged to a disengaged position. In particular, the plunger 90 via the release tab 93 rotates the latch 101 such that the latch 101 overcomes the force of the biasing member 106 and disengages the locking notch 104 from the locking recess 199, thereby unlocking the rail adapter assembly 150 from the base plate assembly 20. After the locking assembly 100 moves into a disengaged position, the rail adapter assembly 150 is ready to be removed from the base plate assembly 20. The user exerts a pulling force on the attached pistol in a direction along the central axis of the base plate 30. This force moves the rail adapter assembly 150 such that the first and second sides 195 and 196 of the interface 191 slide within the grooves 46 and 47 of the guide rails 41 and 42 until the second end 194 clears the guide channel 43. As the user begins removing the pistol, the locking recess 199 no longer aligns with the locking notch 104, and the guide face 197 maintains the locking notch 104 disengaged. The user accordingly releases the actuator 91, and, once the second end 194 clears the guide channel 43, the pistol along with the attached rail adapter assembly 150 separates from the base plate assembly 20 for target engagement. The biasing member 106 returns the locking assembly 100 to its engaged position when the rail adapter assembly 150 separates from the base plate assembly 20.

Figure 15:
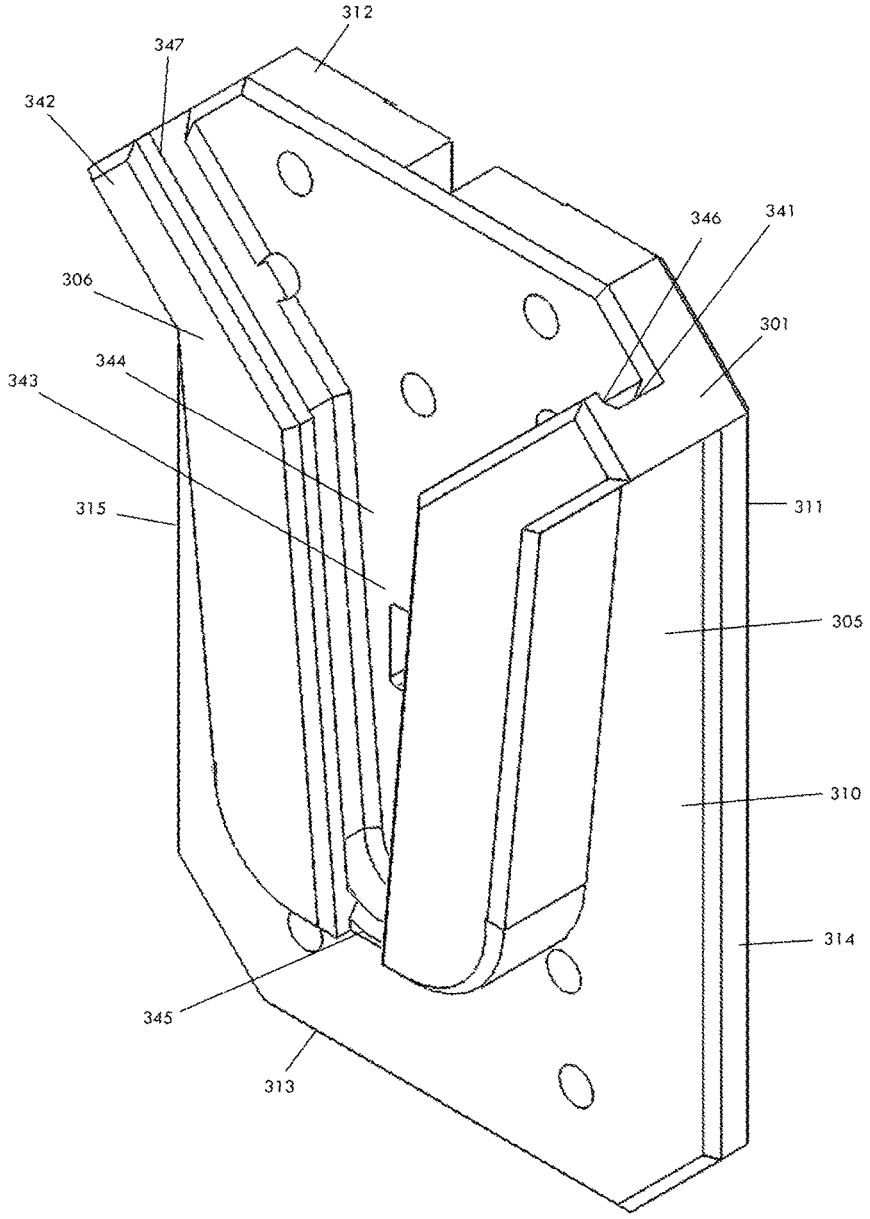
FIG. 15 is a front view in perspective illustrating a base plate assembly for a retention system according to a second embodiment.
Figure 16:
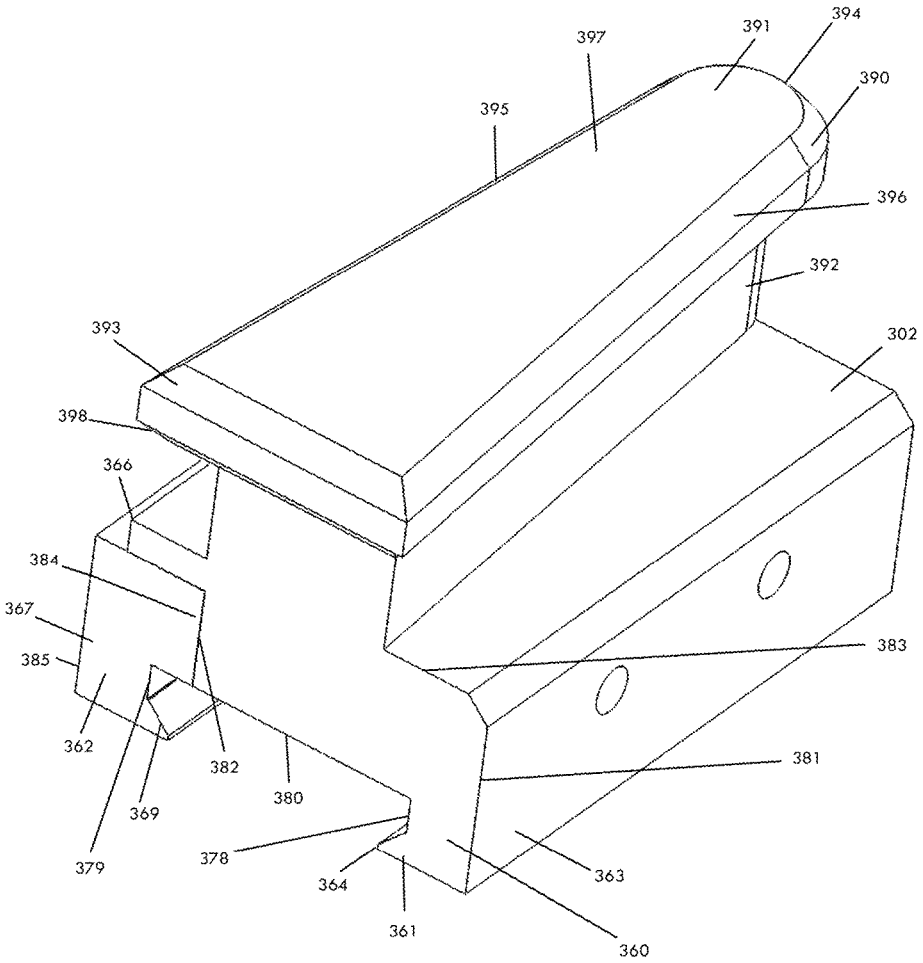
FIG. 16 is a perspective view illustrating a rail adapter assembly for the retention system according to the second embodiment.
Figure 17:
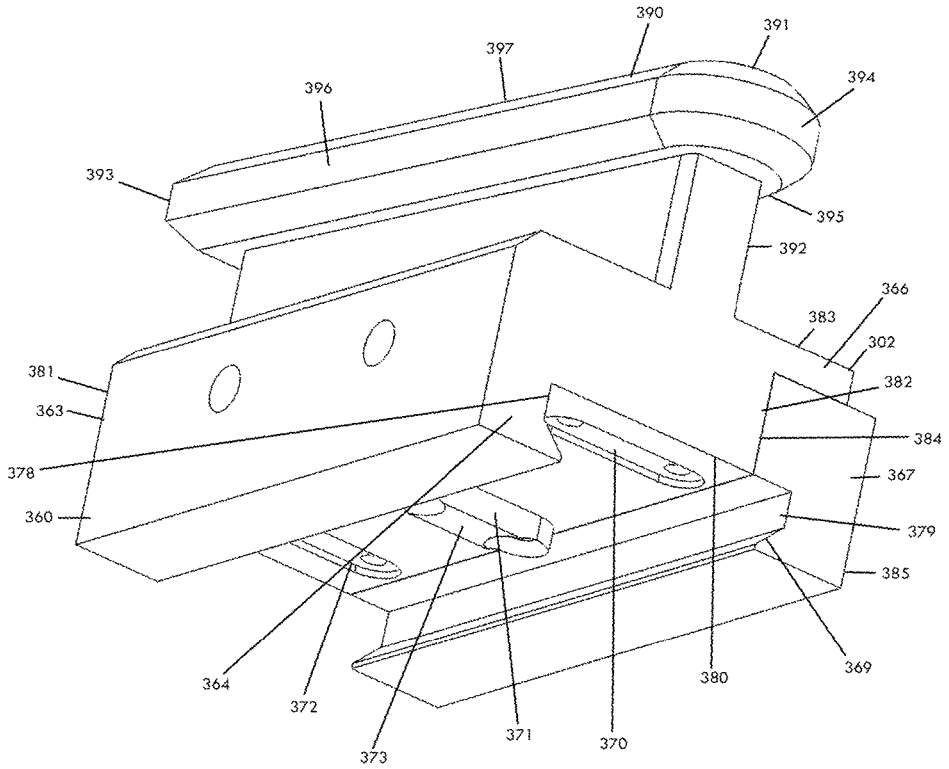
FIG. 17 is a perspective view illustrating the rail adapter assembly for the retention system according to the second embodiment.
Figure 18:
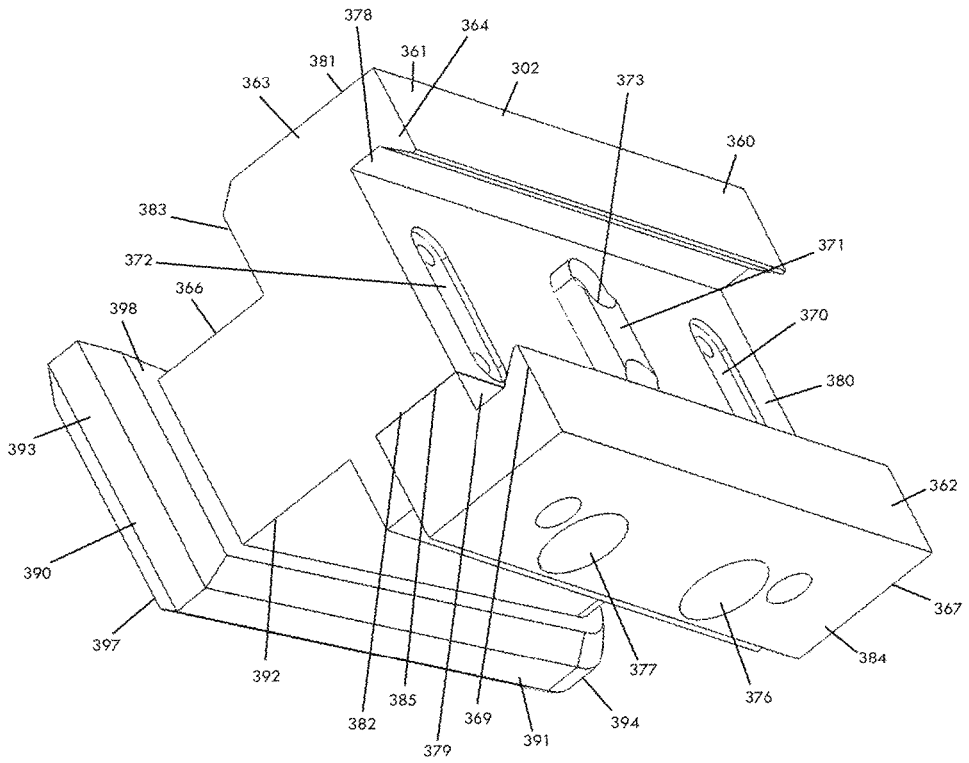
FIG. 18 is a perspective view illustrating the rail adapter assembly bly for the retention system according to the second embodiment.
Figure 19:
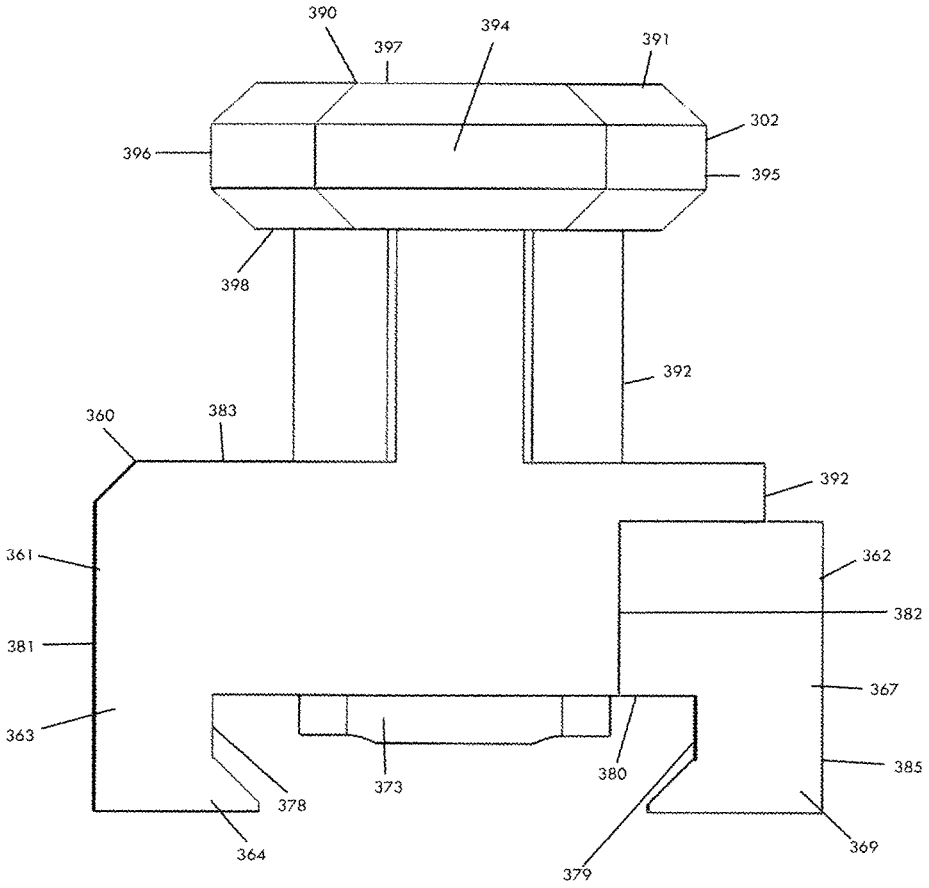
FIG. 19 is a front view illustrating the rail adapter assembly for the retention system according to the second embodiment.

FIGS. 15-18 illustrate a retention system 300 according to a second embodiment. The retention system 300 includes a base plate assembly 301 and a rail adapter assembly 302. Referring specifically to FIG. 15, the base plate assembly 301 is substantially similar to base plate assembly 20 of the retention system 10. However, the base plate assembly 301 does not positively engage the rail adapter assembly 302. As such, the base plate assembly 301 does not incorporate a plunger channel 50, a locking assembly channel 60, a locking assembly 100, a back plate groove 70, an aperture 39, a plunger 90, and a back plate 88.

The base plate assembly 301 includes a base plate 305, substantially rectangular in the present embodiment, and having a front 310, a back 311, a top 312, a bottom 313, a right side 314, and a left side 315. The base plate 305 at the back 311 includes bores that, in the present embodiment have rivets press fit therein. The rivets are threaded to allow coupling of the base plate assembly 301 with various attachment devices. Illustratively, molly straps securable to a variety of surfaces such as tactical vests or belts may be attached to the base plate 305.

The base plate assembly 301 further includes a rail adapter assembly guide 306 residing at the front 310 of the base plate 305. The rail adapter assembly guide 306 includes guide rails 341 and 342 defining a guide channel 343 and a guide surface 344. The rail adapter assembly guide 306 further includes a stop 345 at a lower end thereof between the guide ails 341 and 342. The guide rails 341 and 342 include grooves 346 and 347, respectively, provided to engage the rail adapter assembly 302. In the present embodiment, the guide rails 341 and 342 are shaped to form a funnel that is wide near the top 312 of the base plate 305 and tapers as it approaches the bottom 313 of the base plate 305. The funnel shape of the guide rails 341 and 342 as well as the grooves 346 and 347 direct the rail adapter assembly 302 into the rail adapter assembly guide 306 in order to allow a user of the retention system 300 to rapidly secure a weapon or the like to the base plate assembly 301 through tactile feel as will be explained in greater detail herein.

The rail adapter assembly 302 mounts to any suitable rail system for a piece of equipment. Illustratively, the rail adapter assembly 302 mounts to an accessory rail of a rifle such that interfacing of the rail adapter assembly 302 with the base plate assembly 301 secures the rifle to a user. The rail adapter assembly 302 may be constructed from any suitable mate such as aluminum, titanium, or carbon fiber.

The rail adapter assembly 302 includes a clamp 360 and an interface assembly 390. The clamp includes a first clamp member 361 and a second clamp member 362. The first clamp member 361 includes a main body 363 having lug slots 370-372 on an upper surface 380 thereof and attachment points on a first and second sides 381 and 382 thereof. The main body 363 further includes a jaw 364 integral therewith at the first side 381, a interface assembly 390 integral therewith with at a bottom 383 thereof, and a clamp member support 366 integral therewith at the second side 382. The interface assembly 390 includes an interface 391 and an interface bracket 392. The second clamp member 362 includes a main body 367 having a jaw 369 integral therewith at a first side 384 and recessed apertures 376 and 377 and attachment points at a second side 385. While the first and second clamp members 361 and 362 may be constructed from any suitable material including carbon fiber, the clamp members in the present embodiment are aluminum. In addition, the attachment points in the present embodiment are holes drilled and tapped, although, one of ordinary skill in the art will recognize alternative attachment points and methods.

The clamp member support 366 of the first clamp member 361 is a bracket that receives and supports the second clamp member 362 when the second clamp member 362 attaches to the main body 363 of the first clamp member 361. The second clamp member 362 resides atop the clamp member support 366 and attaches to the main body 363 of the first clamp member 361 using any suitable means. However, in the present embodiment, the second clamp member 362 attaches to the main body 363 of the first clamp member 361 using screws placed within and extending through the recessed apertures 376 and 377 such that the screws engage the attachment points located on the second side 382 of the main body 363 for the first clamp member 361.

As stated above, the clamp 360 is designed to integrate with a common device rail such as a picatinny or weaver type rail. Accordingly, the jaw 364 of the first clamp member 361 includes a groove 378 and the jaw 365 the second clamp member 362 includes a groove 379 designed to receive therein the device rail of a piece of equipment. Furthermore, the second clamp member 362 is adjustable relative to the main body 363 of the first clamp member 361 between a disengaged position and an engaged position, whereby the clamp 360 secures to the device rail. In addition, the lug slots 370-372 are designed to receive and secure a lug 373 to the first clamp member 361. The lug 373 fits within the slots of a device rail and allows fore and aft adjustment on the device rail as well as prevents fore and aft movement of the rail adapter assembly 302 when the rail adapter assembly 302 is attached a piece of equipment.

The interface 391 and the interface bracket 392 of the interface assembly 390 in the present embodiment are formed integrally with the first clamp member 361 from any suitable material, such as plastic or metal, and manufactured using any suitable method such as milling or injection molding. In particular, the interface 391, the interface bracket 392, and the first clamp member 361 are milled as one piece from aluminum. Nevertheless, those of ordinary skill in the art will recognize that the interface 391, the interface bracket 392, and the first clamp member 361 could be formed separately and combined.

The interface 391 includes a first end 393, a second end 394, and first and second sides 395 and 396. In the present embodiment, second end 394 incorporates a curved surface to facilitate insertion of the interface 391 into the rail adapter assembly guide 306. The interface 391 further includes a guide face 397 and a platform face 398.

The interface 391 in the present embodiment is triangular in shape and engages the rail adapter assembly guide 306 using a tongue and groove method. The triangular shape of the interface 391 produces a taper from the first end 393 to the second end 394 and allows a user to guide the interface 391 and therefore the rail adapter assembly 302 into the rail adapter assembly guide 306 of the base plate assembly 301 for securing thereto. In particular, the first and second sides 395 and 396 slide within and engage the grooves 346 and 347 of the guide rails 341 avid 342. The interface 391 inserts into the rail adapter assembly guide 306 until the second end 394 abuts the stop 345 of the rail adapter assembly guide 306.

To aid in the understanding of the present invention, the retention system 300 will be described herein used in combination with a weapon, in particular a rifle. A user begins by coupling the base plate assembly 301 with an attachment device such as molly straps. The user couples the base plate assembly 301 to the molly straps by placing screws into the threaded rivets within the bores located at the back thereof. The base plate assembly 301 via the coupled molly straps is then attached to a suitable surface on the user such as a belt or tactical vest.

A user next attaches the clamp 360 to a device rail of a rifle. The user selects a lug slot 370-372 of the first clamp member 361 and secures the lug 373 therein. As previously described, the second clamp member 362 resides atop the clamp member support 367 and attaches to the first clamp member 361 using screws placed within and extending through the recessed apertures 376 and 377 such that the screws engage the attachment points located on the second side 382 of the main body 363 for the first clamp member 361. While the second clamp member 362 and the first clamp member 361 couple together, it should be noted that, at this point, the second clamp member 362 begins in a disengaged position relative to the first clamp member 361. In the disengaged position the screws remain untightened, and the second clamp member 362 moves relative to the first clamp member 361 in order to allow adjustability when securing the clamp 360 on the device rail. A user aligns the clamp 360 of the rail adapter assembly 302 with the device rail of the rifle such that the groove 378 of the first clamp member 361 aligns with a first side of the device rail and the groove 379 of the second clamp member 362 aligns with a second side of the device rail. In addition, the user selects a slot on the device rail and places the lug 373 within the slot. The user then moves the second clamp member 362 into its engaged position by tightening the screws, resulting in the jaw 364 of the first clamp member 361 engaging the first side of the device rail and the jaw 369 of the second clamp member 362 engaging the second side of the device rail. In the engaged position of the second clamp member 362, the clamp 360 remains secured to the device rail of the rifle, while the lug 373 prevents fore or aft movement of the clamp 360 along the device rail. While the foregoing example employs the lug 373 inserted into a slot of the device rail for the rifle, one of ordinary skill in the art will recognize that the lug 373 may be removed from the clamp 360 for device rails without slots.

Once the rail adapter assembly 302 is secured to the device rail of the rifle, the rail adapter assembly 302 as well as the rifle is ready for securing with the base plate assembly 301. The user grasps the rifle and positions the rail adapter assembly 301 such that the second end 394 of the interface 391 aligns with the guide channel 343 of the rail adapter assembly guide 340 and the guide face 397 of the interface 391 aligns with the guide surface 344. After alignment, the user exerts a pushing force on the attached rifle in a direction along the central axis of the base plate 305. This pushing force moves the first and second sides 395 and 396 of the interface 391 into engagement with the grooves 346 and 347 of the guide rails 341 and 342, thereby inserting the interface 391 into the rail adapter assembly guide 340. The interface 391 inserts into the rail adapter assembly guide 340 until the second end 394 abuts the stop 345 of the rail adapter assembly guide 40 thereby attaching the rail adapter assembly 302 and thus the rifle to the base plate assembly 301.

To remove the rail adapter assembly 302 as well as the rifle from the base plate assembly 301, the user exerts a pulling force on the attached rifle in a direction along the central axis of the base plate 305. This force moves the rail adapter assembly 302 such that the first and second sides 395 and 396 of the interface 391 slide within the grooves 346 and 347 of the guide rails 341 and 342 until the second end 394 clears the guide channel 343.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. A retention system for equipment, comprising:

an adapter assembly securable to equipment, the adapter assembly, comprising:

an interface having a locking recess, a clamp comprising a first clamp member adjustably securable to a second clamp member such that the first clamp member and the second clamp member are adapted to engage a device rail of equipment, and an interface bracket coupled with the interface, the interface bracket being selectively engageable with one of the first clamp member and the second clamp member, wherein the interface bracket is removable from the second clamp member and engageable with the first clamp member for a right handed configuration, further wherein the interface bracket is removable from the first clamp member and engageable with the second clamp member for a left handed configuration;

a base plate assembly, comprising:

a base plate, an adapter assembly guide adjacent the base plate wherein the adapter assembly guide receives the interface therein thereby coupling the adapter assembly with the base plate assembly, and a locking mechanism coupled with the base plate, and being user movable from an engaged position to a disengaged position, wherein, in the engaged position, the locking mechanism engages the locking recess of the interface, thereby locking the adapter assembly with the base plate assembly, and further wherein, when a user moves the locking mechanism to the disengaged position, the locking mechanism disengages from the locking recess of the interface, thereby unlocking the adapter assembly from the base plate assembly.

2. The retention system for equipment according to claim 1, wherein the first clamp member includes a rail facilitating the attachment of devices thereto.

3. The retention system for equipment according to claim 1, wherein the first clamp member, comprises:

a main body having at least one lug slot on an upper surface thereof; and a jaw engageable with a device rail of equipment.

4. The retention system for equipment according to claim 1, wherein the second clamp member, comprises:

a main body adjustably securable with the main body of the first clamp member; and a jaw engageable with a device rail of equipment.

5. The retention system for equipment according to claim 1, wherein the base plate includes a plunger channel, a locking assembly channel communicating with the plunger channel, and an aperture communicating with the locking assembly channel.

6. The retention system for equipment according to claim 5, wherein the locking mechanism comprises:

a locking assembly disposed in the locking assembly channel and biased to extend through the aperture such that the locking assembly engages the locking recess of the interface; and a plunger communicating with the locking assembly, the plunger disposed in the plunger channel and extending therefrom, wherein movement of the plunger moves the locking assembly from the aperture such that the locking assembly disengages from the locking recess of the interface.

7. The retention system for equipment according to claim 6, wherein insertion of the interface of the adapter assembly into the adapter assembly guide depresses the locking assembly until the locking recess of the interface aligns with the aperture of the base plate.

8. The retention system for equipment according to claim 6, wherein the plunger includes a ward engagement key and the plunger channel includes a ward, further wherein the ward limits the movement of the plunger relative to the locking assembly.

9. The retention system for equipment according to claim 6, wherein the locking assembly comprises:

a hinge pin;

a latch pivotable about the hinge pin; and a biasing member that biases the latch to extend through the aperture such that the latch engages the locking recess of the interface, wherein movement of the plunger relative to the latch overcomes the biasing force of the biasing member and moves the latch from the aperture such that the latch disengages from the locking recess of the interface.

10. The retention system for equipment according to claim 6, wherein the base plate assembly further comprises a back plate securable with the base plate to maintain the plunger within the plunger channel and the locking assembly within the locking assembly channel.

11. The retention system for equipment according to claim 1, wherein the base plate includes threaded rivets therein that facilitate securing of the base plate assembly with devices adapted for attachment to an object or a wearer of the retention system.

12. The retention system for equipment according to claim 1, wherein the interface of the adapter assembly includes a first upper end and a second lower end, wherein the interface tapers from the first upper end to the second lower end such that the first upper end is wider than the second lower end.

13. The retention system for equipment according to claim 12, wherein the adapter assembly guide includes a first guide rail having a first upper portion and a second lower portion opposed to a second guide rail having a first upper portion and a second lower portion, the first and second guide rails defining a funnel shape whereby their first upper portions taper to their second lower portions, wherein the first upper portions are wider than the first upper end of the interface of the adapter assembly to facilitate insertion of the interface between the first and second guide rails and further to funnel the interface toward the second lower portions, further wherein the first and second guide rails taper along their second lower portions and are spaced apart at their second lower portions substantially the same as the width of the interface of the adapter assembly such that the first and second guide rails engage the interface thereby coupling the adapter assembly with the base plate assembly.

14. The retention system for equipment according to claim 13, wherein the first and second guide rails each define a groove that engages the interface of the adapter assembly to maintain the adapter assembly seated between the first and second guide rails.

15. The retention system for equipment according to claim 13, wherein the adapter assembly guide includes a stop that arrests the insertion of the interface of the adapter assembly therein.

16. A retention system for equipment, comprising:

an adapter assembly securable to equipment, the adapter assembly, comprising:

a triangular shaped interface having a width and defining a base at a first upper end and a rounded apex at a second lower end, wherein the interface tapers from the first upper end to the second lower end such that the base at the first upper end is wider than the rounded apex at the second lower end, further wherein the rounded apex at the second lower end provides a point of insertion for the interface, a clamp comprising a first clamp member adjustably securable to a second clamp member such that the first clamp member and the second clamp member are adapted to engage a device rail of equipment, and an interface bracket coupled with the interface, the interface bracket being selectively engageable with one of the first clamp member and the second clamp member, wherein the interface bracket is removable from the second clamp member and engageable with the first clamp member for a right handed configuration, further wherein the interface bracket is removable from the first clamp member and engageable with the second clamp member for a left handed configuration;

a base plate assembly, comprising:

a base plate, and an adapter assembly guide adjacent the base plate for receiving therein the interface of the adapter assembly, the adapter assembly guide including a first guide rail having a first upper portion and a second lower portion opposed to a second guide rail having a first upper portion and a second lower portion, the first and second guide rails defining a funnel shape whereby their first upper portions taper to their second lower portions, wherein the first upper portions are wider than the base at the first upper end of the interface of the adapter assembly to provide an entrance for the rounded apex at the second lower end of the interface between the first and second guide rails and further to funnel the interface toward the second lower portions whereby the interface due to the rounded apex at the second lower end enters the second lower portions, further wherein the first and second guide rails taper along their second lower portions and are spaced apart at their second lower portions substantially the same as the width of the interface of the adapter assembly such that the first and second guide rails engage the interface thereby coupling the adapter assembly with the base plate assembly.

17. The retention system for equipment according to claim 16, wherein the first and second guide rails each define a groove that engages the interface of the adapter assembly to maintain the adapter assembly seated between the first and second guide rails.

18. The retention system for equipment according to claim 16, wherein the adapter assembly guide includes a stop that arrests the insertion of the interface of the adapter assembly therein.

19. The retention system for equipment according to claim 16, wherein the first clamp member includes a rail facilitating the attachment of devices thereto.

20. The retention system for equipment according to claim 16, wherein the first clamp member, comprises:

a main body having at least one lug slot on an upper surface thereof; and a jaw engageable with a device rail of equipment.

21. The retention system for equipment according to claim 16, wherein the second clamp member, comprises:

a main body adjustably securable with the main body of the first clamp member; and a jaw engageable with a device rail of equipment.

22. The retention system for equipment according to claim 16, wherein:

the interface of the adapter assembly includes a locking recess; and the base plate assembly, further comprises a locking mechanism coupled with the base plate, and being user movable from an engaged position to a disengaged position, wherein, in the engaged position, the locking mechanism engages the locking recess of the interface, thereby locking the adapter assembly with the base plate assembly, and further wherein, when a user moves the locking mechanism to the disengaged position, the locking mechanism disengages from the locking recess of the interface, thereby unlocking the adapter assembly from the base plate assembly.

23. The retention system for equipment according to claim 22, wherein the base plate includes a plunger channel, a locking assembly channel communicating with the plunger channel, and an aperture communicating with the locking assembly channel.

24. The retention system for equipment according to claim 23, wherein the locking mechanism comprises:

a locking assembly disposed in the locking assembly channel and biased to extend through the aperture such that the locking assembly engages the locking recess of the interface; and a plunger communicating with the locking assembly, the plunger disposed in the plunger channel and extending therefrom, wherein movement of the plunger moves the locking assembly from the aperture such that the locking assembly disengages from the locking recess of the interface.

25. The retention system for equipment according to claim 24, wherein insertion of the interface of the adapter assembly into the adapter assembly guide depresses the locking assembly until the locking recess of the interface aligns with the aperture of the base plate.

26. The retention system for equipment according to claim 24, wherein the plunger includes a ward engagement key and the plunger channel includes a ward, further wherein the ward limits the movement of the plunger relative to the locking assembly.

27. The retention system for equipment according to claim 24, wherein the locking assembly comprises:

a hinge pin;

a latch pivotable about the hinge pin; and a biasing member that biases the latch to extend through the aperture such that the latch engages the locking recess of the interface, wherein movement of the plunger relative to the latch overcomes the biasing force of the biasing member and moves the latch from the aperture such that the latch disengages from the locking recess of the interface.

28. The retention system for equipment according to claim 24, wherein the base plate assembly further comprises a back plate securable with the base plate to maintain the plunger within the plunger channel and the locking assembly within the locking assembly channel.

29. The retention system for equipment according to claim 16, wherein the base plate includes threaded rivets therein that facilitate securing of the base plate assembly with devices adapted for attachment to an object or a wearer of the retention system.

30. A retention system for equipment, comprising:

an adapter assembly securable to equipment, the adapter assembly, comprising:

an interface, a clamp comprising a first clamp member adjustably securable to a second clamp member such that the first clamp member and the second clamp member are adapted to engage a device rail of equipment, and an interface bracket coupled with the interface, the interface bracket being selectively engageable with one of the first clamp member and the second clamp member, wherein the interface bracket is removable from the second clamp member and engageable with the first clamp member for a right-handed configuration, further wherein the interface bracket is removable from the first clamp member and engageable with the second clamp member for a left-handed configuration;

a base plate assembly, comprising:

a base plate, an adapter assembly guide adjacent the base plate wherein the adapter assembly guide receives the interface therein thereby coupling the adapter assembly with the base plate assembly, and a locking mechanism coupled with the base plate, and being user movable from an engaged position to a disengaged position, wherein, in the engaged position, the locking mechanism engages the interface, thereby locking the adapter assembly with the base plate assembly, and further wherein, when a user moves the locking mechanism to the disengaged position, the locking mechanism disengages from the interface, thereby unlocking the adapter assembly from the base plate assembly.

31. The retention system for equipment according to claim 30, wherein the first clamp member includes a rail facilitating the attachment of devices thereto.

32. The retention system for equipment according to claim 30, wherein the first clamp member, comprises:

a main body having at least one lug slot on an upper surface thereof; and a jaw engageable with a device rail of equipment.

33. The retention system for equipment according to claim 30, wherein the second clamp member, comprises:

a main body adjustably securable with the main body of the first clamp member; and a jaw engageable with a device rail of equipment.

34. The retention system for equipment according to claim 30, wherein the base plate includes a plunger channel, a locking assembly channel communicating with the plunger channel, and an aperture communicating with the locking assembly channel.

35. The retention system for equipment according to claim 34, wherein the locking mechanism comprises:

a locking assembly disposed in the locking assembly channel and biased to extend through the aperture such that the locking assembly engages the interface; and a plunger communicating with the locking assembly, the plunger disposed in the plunger channel and extending therefrom, wherein movement of the plunger moves the locking assembly from the aperture such that the locking assembly disengages from the interface.

36. The retention system for equipment according to claim 35, wherein insertion of the interface of the adapter assembly into the adapter assembly guide depresses the locking assembly until the interface aligns with the aperture of the base plate.

37. The retention system for equipment according to claim 35, wherein the plunger includes a ward engagement key and the plunger channel includes a ward, further wherein the ward limits the movement of the plunger relative to the locking assembly.

38. The retention system for equipment according to claim 35, wherein the locking assembly comprises:

a hinge pin;

a latch pivotable about the hinge pin; and a biasing member that biases the latch to extend through the aperture such that the latch engages the interface, wherein movement of the plunger relative to the latch overcomes the biasing force of the biasing member and moves the latch from the aperture such that the latch disengages from the interface.

39. The retention system for equipment according to claim 35, wherein the base plate assembly further comprises a back plate securable with the base plate to maintain the plunger within the plunger channel and the locking assembly within the locking assembly channel.

40. The retention system for equipment according to claim 30, wherein the base plate includes threaded rivets therein that facilitate securing of the base plate assembly with devices adapted for attachment to an object or a wearer of the retention system.

41. The retention system for equipment according to claim 30, wherein the interface of the adapter assembly includes a first upper end and a second lower end, wherein the interface tapers from the first upper end to the second lower end such that the first upper end is wider than the second lower end.

42. The retention system for equipment according to claim 41, wherein the adapter assembly guide includes a first guide rail having a first upper portion and a second lower portion opposed to a second guide rail having a first upper portion and a second lower portion, the first and second guide rails defining a funnel shape whereby their first upper portions taper to their second lower portions, wherein the first upper portions are wider than the first upper end of the interface of the adapter assembly to facilitate insertion of the interface between the first and second guide rails and further to funnel the interface toward the second lower portions, further wherein the first and second guide rails taper along their second lower portions and are spaced apart at their second lower portions substantially the same as the width of the interface of the adapter assembly such that the first and second guide rails engage the interface thereby coupling the adapter assembly with the base plate assembly.

43. The retention system for equipment according to claim 42, wherein the first and second guide rails each define a groove that engages the interface of the adapter assembly to maintain the adapter assembly seated between the first and second guide rails.

44. The retention system for equipment according to claim 42, wherein the adapter assembly guide includes a stop that arrests the insertion of the interface of the adapter assembly therein.

* * * * *